US008083304B2

(12) United States Patent
Hu

(10) Patent No.: US 8,083,304 B2
(45) Date of Patent: Dec. 27, 2011

(54) SELF CLOSING MECHANISM FOR DRAWER SLIDES

(75) Inventor: Thomas Sheng-Shyong Hu, Corona, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 657 days.

(21) Appl. No.: 12/174,199

(22) Filed: Jul. 16, 2008

(65) Prior Publication Data

US 2009/0021129 A1 Jan. 22, 2009

Related U.S. Application Data

(60) Provisional application No. 60/959,988, filed on Jul. 18, 2007.

(51) Int. Cl.
*A47B 95/00* (2006.01)

(52) U.S. Cl. ..... 312/333; 312/319.1; 312/334.8

(58) Field of Classification Search ..... 312/333, 312/334.44, 319.1, 334.7, 334.8, 334.47; 384/21

See application file for complete search history.

(56) References Cited

U.S. PATENT DOCUMENTS

| | | | | |
|---|---|---|---|---|
| 4,317,254 | A | 3/1982 | Chaddock | |
| 4,383,707 | A | 5/1983 | Nishimura | |
| 4,596,427 | A | 6/1986 | Pflugfelder | |
| 4,629,167 | A | 12/1986 | Kimura et al. | |
| 5,201,512 | A | 4/1993 | Rabin | |
| 5,207,781 | A | 5/1993 | Rock | |
| 5,474,375 | A | 12/1995 | Hollenstein et al. | |
| 5,979,066 | A * | 11/1999 | Buschle | 33/27.02 |
| 6,266,847 | B1 | 7/2001 | Krumhauer | |
| 6,408,483 | B1 | 6/2002 | Salice | |
| 6,499,818 | B2 | 12/2002 | Brustle | |
| 6,553,617 | B1 | 4/2003 | Salice | |
| 6,629,738 | B2 | 10/2003 | Salice | |
| 6,733,097 | B2 | 5/2004 | Kim et al. | |
| 6,736,471 | B2 * | 5/2004 | Lin | 312/333 |
| 6,752,478 | B1 | 6/2004 | Francz | |
| 6,846,053 | B2 | 1/2005 | Salice | |
| 6,848,759 | B2 | 2/2005 | Doornbos et al. | |

(Continued)

FOREIGN PATENT DOCUMENTS

CA 2 573 939 A1 11/2007

(Continued)

OTHER PUBLICATIONS

PCT International Search Report, Mar. 31, 2009 (PCT/US2008/008750) (5 pages).

*Primary Examiner* — Janet M Wilkens
*Assistant Examiner* — Daniel Rohrhoff
(74) *Attorney, Agent, or Firm* — Pillsbury Winthrop Shaw Pittman LLP

(57) ABSTRACT

A self-closing mechanism for drawer slides includes a stationary housing, a slider, and a latch. The slider is configured to slide relative to the housing, and the latch is configured to translate along with the slider and to rotate within the slider to lock and unlock the slider at predetermined locations. The housing may be coupled to a cabinet member, with a drawer member adapted to engage the latch as the drawer is opened and/or closed. In embodiments of the invention, the self-closing mechanism may include a damper mechanism, such as, e.g., a cylindrical damper or a rotary gear damper.

45 Claims, 39 Drawing Sheets

U.S. PATENT DOCUMENTS

| | | | | |
|---|---|---|---|---|
| 6,866,588 | B2 | 3/2005 | Doornbos | |
| 6,910,557 | B2 | 6/2005 | Doornbos et al. | |
| 6,915,716 | B2 | 7/2005 | Doornbos et al. | |
| 6,932,511 | B2 | 8/2005 | Doornbos et al. | |
| 6,957,807 | B2 | 10/2005 | Zimmer et al. | |
| 6,968,929 | B2 | 11/2005 | Doornbos et al. | |
| 6,997,528 | B2 * | 2/2006 | Yang | 312/333 |
| 7,077,487 | B2 * | 7/2006 | Yang | 312/333 |
| 7,152,718 | B2 | 12/2006 | Doornbos et al. | |
| 7,159,958 | B1 * | 1/2007 | Lu | 312/334.44 |
| 7,244,005 | B1 * | 7/2007 | Lu | 312/333 |
| 7,281,773 | B2 | 10/2007 | Sato et al. | |
| 7,374,261 | B1 * | 5/2008 | Wang | 312/333 |
| 7,399,041 | B2 | 7/2008 | Prentner et al. | |
| 7,465,000 | B2 * | 12/2008 | Huang | 312/333 |
| 2001/0008037 | A1 | 7/2001 | Brustle | |
| 2003/0067257 | A1 | 4/2003 | Gasser | |
| 2003/0080659 | A1 | 5/2003 | Judge et al. | |
| 2004/0183411 | A1 | 9/2004 | Boks | |
| 2006/0043851 | A1 | 3/2006 | Lee | |
| 2007/0132346 | A1 | 6/2007 | Huang | |
| 2008/0061663 | A1 * | 3/2008 | Wu | 312/333 |
| 2008/0100190 | A1 * | 5/2008 | Yang et al. | 312/333 |
| 2008/0111456 | A1 | 5/2008 | Huang | |
| 2009/0033187 | A1 | 2/2009 | Chung | |

FOREIGN PATENT DOCUMENTS

| | | | |
|---|---|---|---|
| DE | 24 21 657 | | 11/1975 |
| DE | 94 11 701.2 | | 11/1994 |
| DE | 296 21 957 | U1 | 4/1997 |
| DE | 296 16 054 | U1 | 2/1998 |
| DE | 002 276 | U1 | 8/1998 |
| DE | 229 16 841 | U1 | 2/2000 |
| DE | 201 21 255 | U1 | 6/2002 |
| DE | 20 2006 001 557 | U1 | 4/2004 |
| DE | 20 2006 000 919 | U1 | 5/2006 |
| DE | 20 2007 011 377 | U1 | 11/2007 |
| DE | 20 2007 011 844 | U1 | 11/2007 |
| DE | 20 2008 000 749 | U1 | 5/2008 |
| EP | 0 556 613 | A1 | 8/1993 |
| EP | 1 113 137 | A1 | 7/2001 |
| EP | 1 350 443 | A1 | 10/2003 |
| EP | 1 468 631 | A1 | 10/2004 |
| GB | 2 022 992 | A | 12/1979 |
| WO | WO 97/31559 | | 9/1997 |
| WO | WO 2006/038748 | A1 | 4/2006 |

* cited by examiner

SELF CLOSING MECHANISM FOR DRAWER SLIDES

RELATED APPLICATION DATA

This application claims priority from Provisional Application Ser. No. 60/959,988, filed Jul. 18, 2007, which is incorporated herein by reference in its entirety.

FIELD OF THE INVENTION

This invention relates to drawer slides and, more particularly, to self-closing mechanisms for drawer slides.

BACKGROUND OF THE INVENTION

The conventional self-closing drawer slide includes a drawer member, an intermediate member, a cabinet member, and a conventional self closing mechanism. The drawer slide facilitates the opening and closing of a drawer in a cabinet. Typically, the drawer slide is mounted between a side of a drawer and a sidewall of a cabinet, with the drawer member affixed to the drawer, and the cabinet member affixed to the cabinet.

The conventional self closing mechanism includes a slide component slidably mounted on the cabinet member of the drawer slide and spring biased in the closing direction of the drawer slide, and an engagement component fixedly mounted on the drawer member of the drawer slide. When the drawer slide is in the closed position, the engagement component is fully engaged with the slide component. As the drawer slide is pulled open, the engagement component pulls the slide component in the opening direction of the drawer slide against the spring force. When the slide component reaches a certain point, it locks into position and releases the engagement component. The slide component remains in the locked position until it is released by the engagement component when the drawer slide is pushed back to a closed position. Once it is released, the spring biased slide component, now back in full engagement with the engagement component, pulls the engagement component in the closing direction of the drawer slide, thereby pulling the drawer slide to a closed position.

The conventional drawer slide has significant drawbacks. To illustrate one drawback, suppose the drawer slide has a width x, and the sidespace within which it is to be mounted (the space between the side of the drawer and the sidewall of the cabinet) is x+y. Ideally, y is 0, but in many cases, y is greater than 0, and the drawer slide does not fit perfectly within the sidespace. For this reason, the conventional drawer slide is designed so that it can be expanded to a maximum width, $x+y_{max}$, before it can no longer function properly.

However, as y increases, the distance between the engagement component on the drawer member and the slide component on the cabinet member increases. As a result, once the sidespace reaches a certain width that is less than $x+y_{max}$, although the drawer slide remains functional, the self closing mechanism does not because the engagement component can no longer reliably engage with the slide component.

Another drawback of the conventional self closing mechanism is that, when mounted within the cabinet member of a drawer slide, it allows the intermediate member to slam against it. Excessive and/or repeated slamming can damage the self closing mechanism and cause it to malfunction.

Another drawback of the conventional self closing mechanism is that it has a high profile such that, when it is mounted within the cabinet member of a drawer slide, it does not allow the intermediate member and/or the drawer member to slide over it. This results in a decreased sliding length with respect to the drawer and intermediate members.

DETAILED DESCRIPTION

Figure 1:
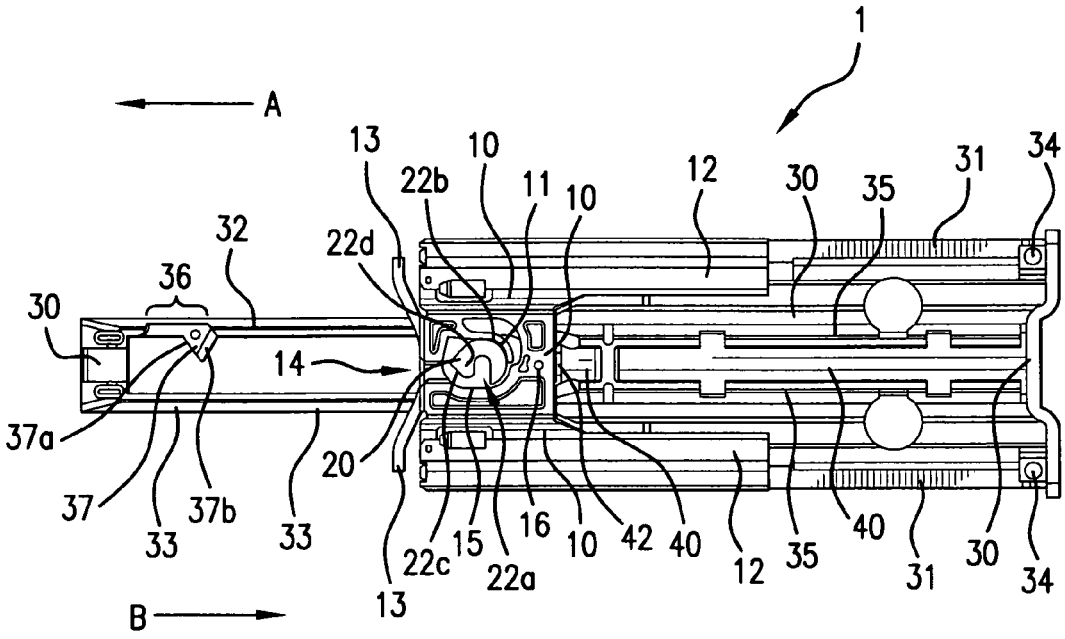
FIG. 1 is a top view of a self-closing mechanism in a closed position in accordance with an embodiment of the invention.
Figure 2:
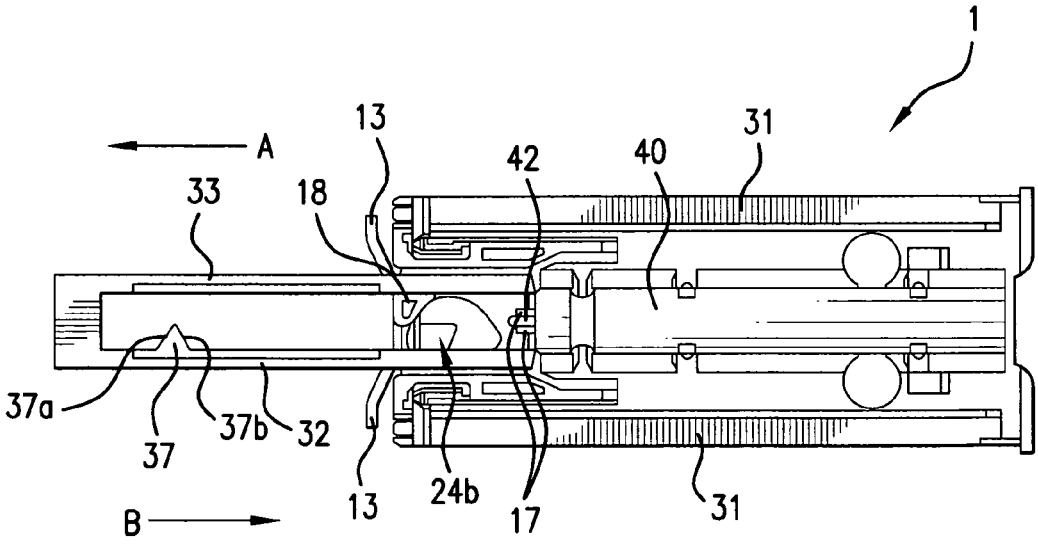
FIG. 2 is a bottom view of the self-closing mechanism shown in FIG. 1.
Figure 3:
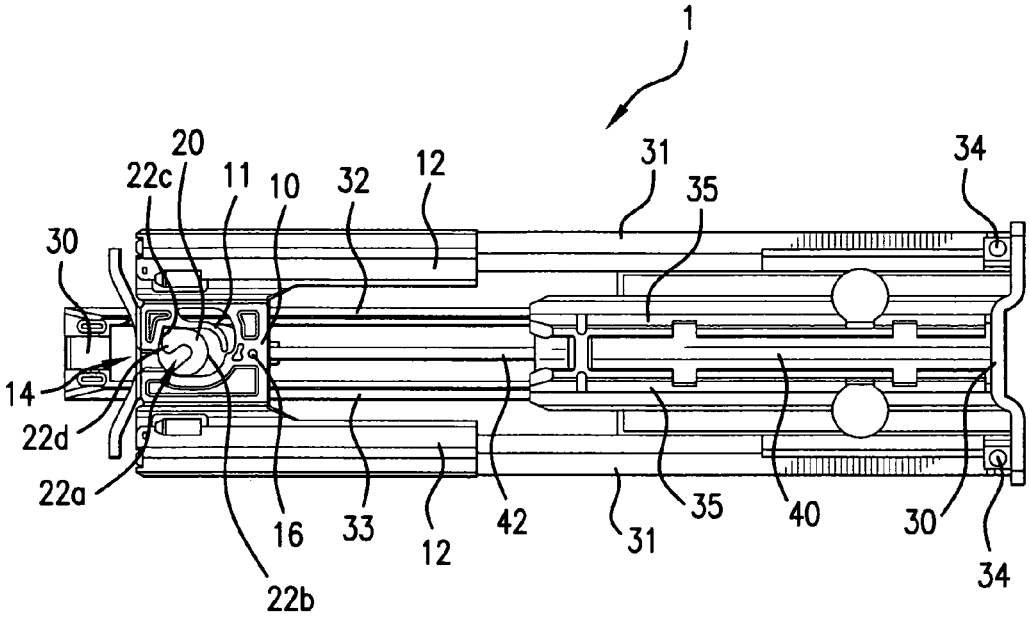
FIG. 3 is a top view of a self-closing mechanism in an open position in accordance with an embodiment of the invention.
Figure 4:
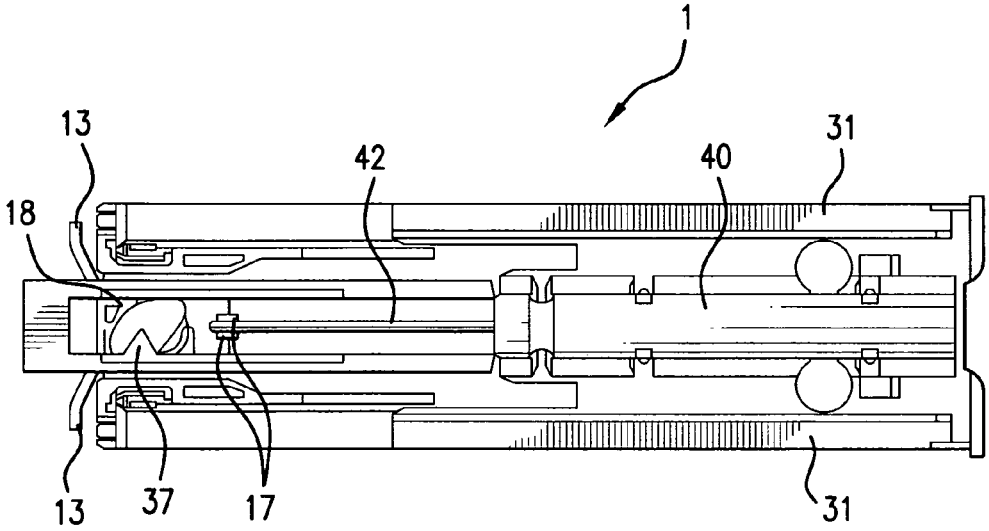
FIG. 4 is a bottom view of the self-closing mechanism shown in FIG. 3.

FIG. 1 is a top view of an embodiment of the present self closing mechanism 1 in the closed position. FIG. 2 is a bottom view of the self closing mechanism 1 shown in FIG. 1 in the closed position. FIG. 3 is a top view of the self closing mechanism 1 shown in FIG. 1 in the open position. FIG. 4 is a bottom view of the self closing mechanism 1 shown in FIG. 1 in the open position. Thus, for ease of reference, the opening direction has been denoted by arrow A, and the closing direction has been denoted by arrow B. In addition, the following description includes the terms "front" and "rear" or "back". The front of a certain component is that portion of the component that is in the opening direction relative to the rear of that component. Additionally, the terms "clockwise" and "counterclockwise" also appear in the description below. Obviously, these terms are relative to the perspective from which the referenced object is being viewed, i.e., clockwise on one side is counterclockwise on the other. Thus, when these terms are used in the description below, the proper perspective is from the top of the self closing mechanism, i.e., the view shown in FIG. 1.

As shown in FIG. 1, an embodiment of the present invention may include a slider 10, a latch 20, a stationary housing 30, and a damper 40.

Figure 5:
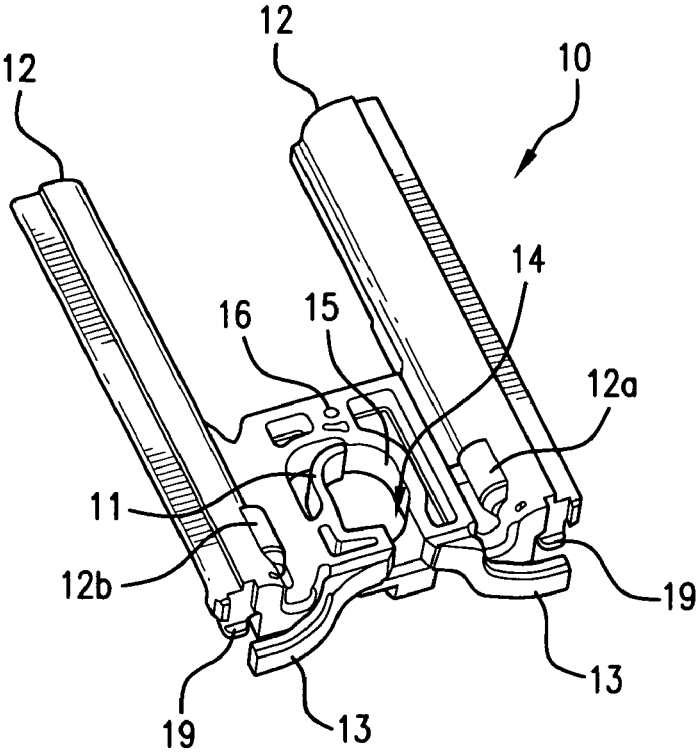
FIG. 5 is a top perspective view of a slider in accordance with an embodiment of the invention.
Figure 6:
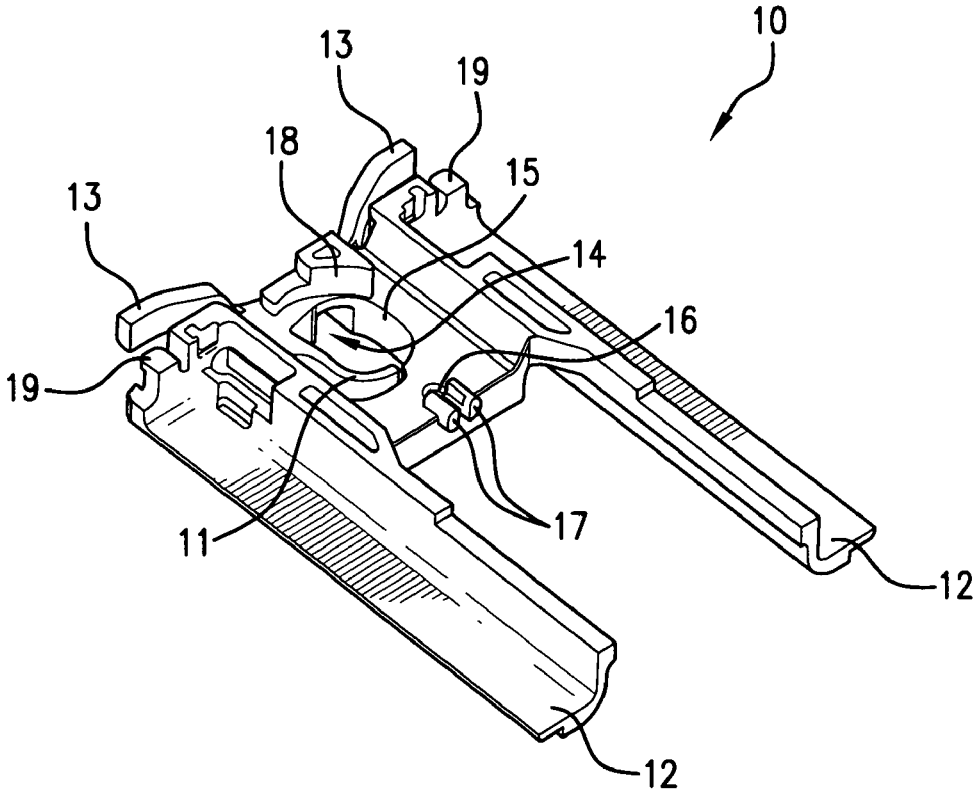
FIG. 6 is a bottom perspective view of the slider shown in FIG. 5.

The slider 10 is shown in further detail in FIG. 5, which is a perspective view of the top of the slider 10, and FIG. 6, which is a perspective view of the bottom of the slider 10. Slider 10 includes a thin finger 11, slider spring shrouds 12, and impact fingers 13. As shown in FIG. 5, slider 10 further includes an aperture 14, an arcuate inner surface 15 and a hole 16. As shown in FIG. 6, slider 10 further includes rod supports 17, a curved wall 18, and spring posts 19 extending downwards proximate the front end of the slider 10.

Figure 7:
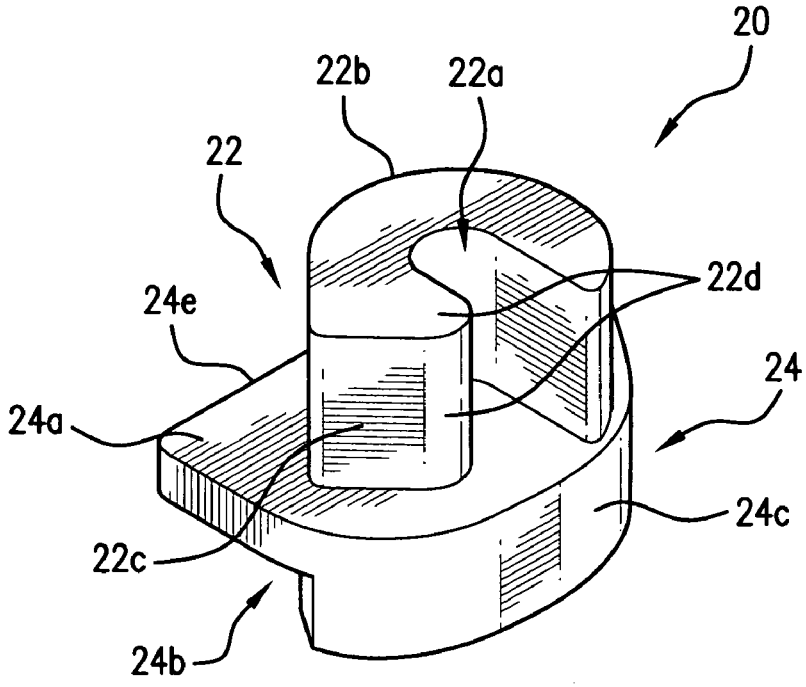
FIG. 7 is a top perspective view of a latch in accordance with an embodiment of the invention.
Figure 8:
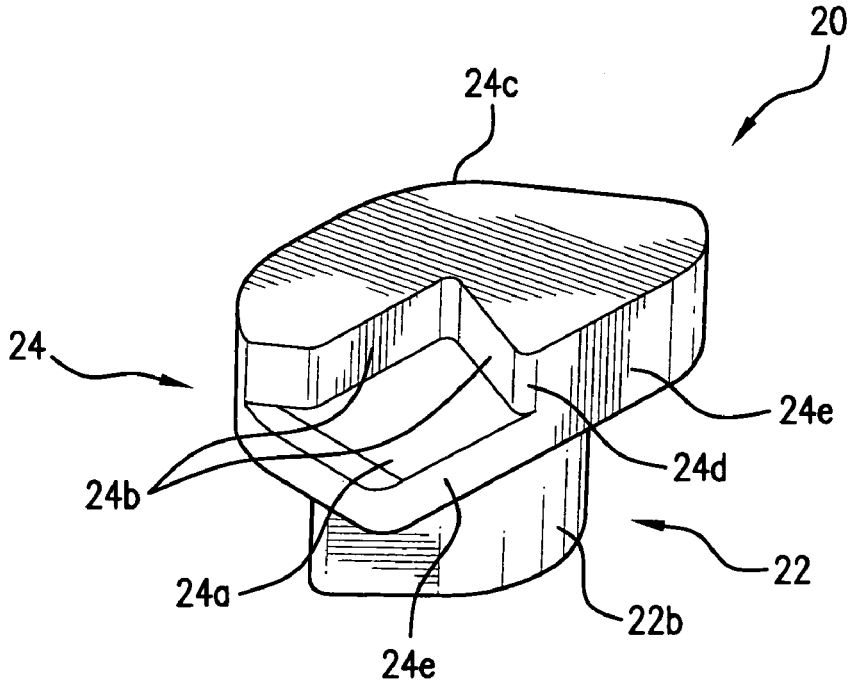
FIG. 8 is a bottom perspective view of the latch shown in FIG. 7.

The latch 20 is shown in further detail in FIG. 7, which is a perspective view of the top of latch 20, and FIG. 8, which is a perspective view of the bottom of latch 20. Latch 20 has a top portion 22 and a bottom portion 24. As shown in FIG. 7, the top portion 22 includes a slot 22*a*, an arcuate outer surface 22*b*, a ramped surface 22*c*, and a lip 22*d*. As shown in FIG. 8, the bottom portion 24 includes a corner 24*a*, a triangular indent 24*b*, a long curved surface 24*c*, a stop edge 24*d*, and a long flat surface 24*e*.

Figure 9:
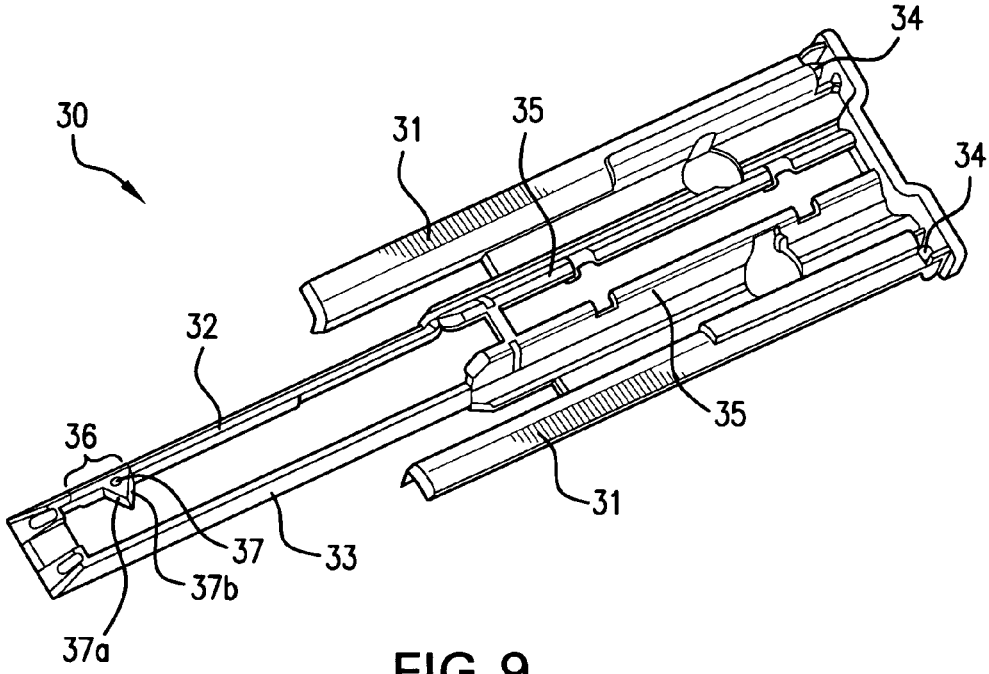
FIG. 9 is a top perspective view of a housing in accordance with an embodiment of the invention.
Figure 10:
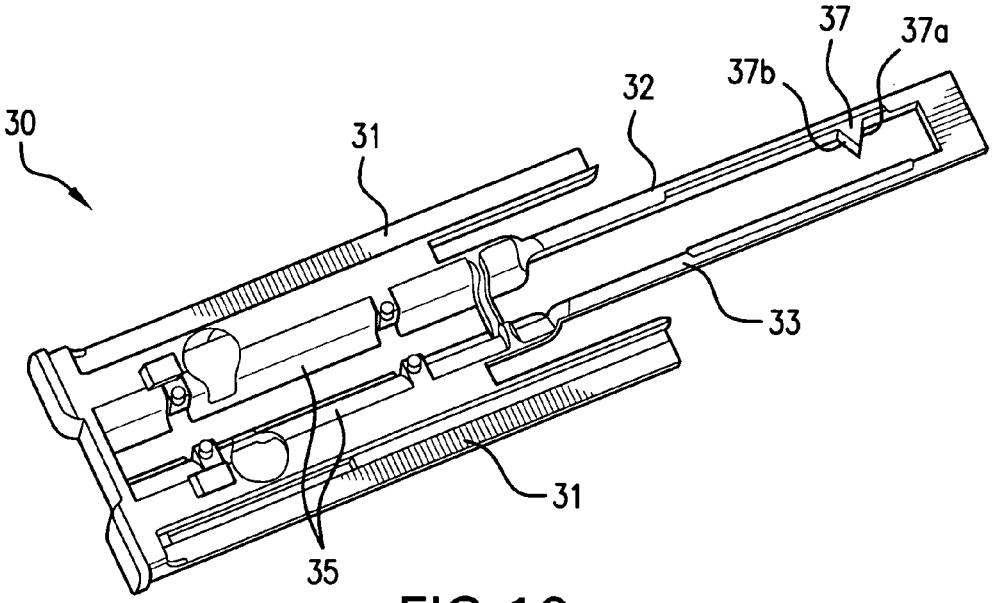
FIG. 10 is a bottom perspective view of the housing shown in FIG. 9.
Figure 11:
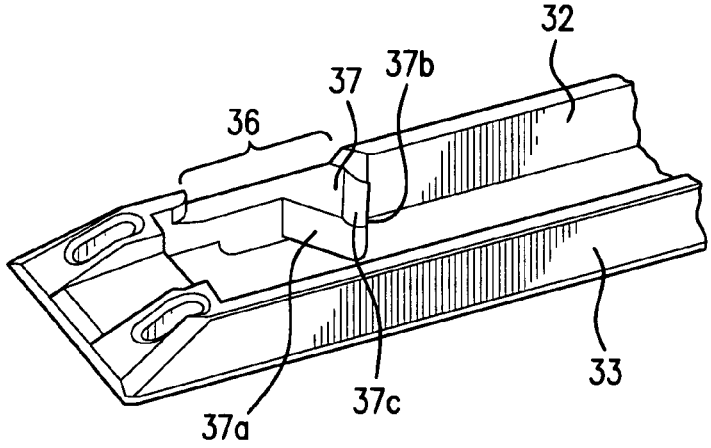
FIG. 11 is a top perspective view of a front portion of the housing shown in FIG. 9.

The stationary housing 30 is shown in further detail in FIG. 9, which is a perspective view of the top of stationary housing 30, FIG. 10, which is a perspective view of the bottom of stationary housing 30, and FIG. 11, which is a perspective view of the front portion of the stationary housing 30. The stationary housing 30 includes stationary spring shrouds 31, a first rail 32, a second rail 33 that is parallel to, and laterally spaced from, the first rail 32, spring posts 34 disposed proximate the rear (or back) end of the housing 30, a recess 36 in the first rail 32, and a male component 37. The male component 37 has a front surface 37*a* and a rear surface 37*b*. In embodiments of the invention, the rear surface 37*b* may include a ramped portion 37*c*. In addition, in embodiments that include a damping mechanism, the housing 30 may include support structure for the damping mechanism. Thus, when, e.g., a cylindrical damper 40 is employed, the housing 30 may further include damper supports 35.

The slider 10 fits over the upper and lower rails 32 and 33 of the stationary housing 30. In addition, slider spring shrouds 12 fit over stationary spring shrouds 31. Two retraction springs (not shown) are connected between the spring posts 19 of the slider 10 and the spring posts 34 of the stationary housing 30, thereby exerting a spring force on the slider 10 in the closing direction. The two retraction springs are situated underneath the slider spring shrouds 12 and the stationary spring shrouds 31.

The damper 40 is situated between the damper supports 35, and includes a piston rod 42, the front end of which is fitted between rod supports 17 and into hole 16.

The latch 20 sits between the slider 10 and the stationary housing 30. More specifically, the upper (or top) portion 22 of the latch 20 is situated in the space between the thin finger 11 and the aperture 14 of the slider 10, and the bottom portion 24 of the latch 20 is situated between the parallel rails 32, 33 of the stationary housing 30. See, e.g., FIGS. 1-4.

Figure 16:
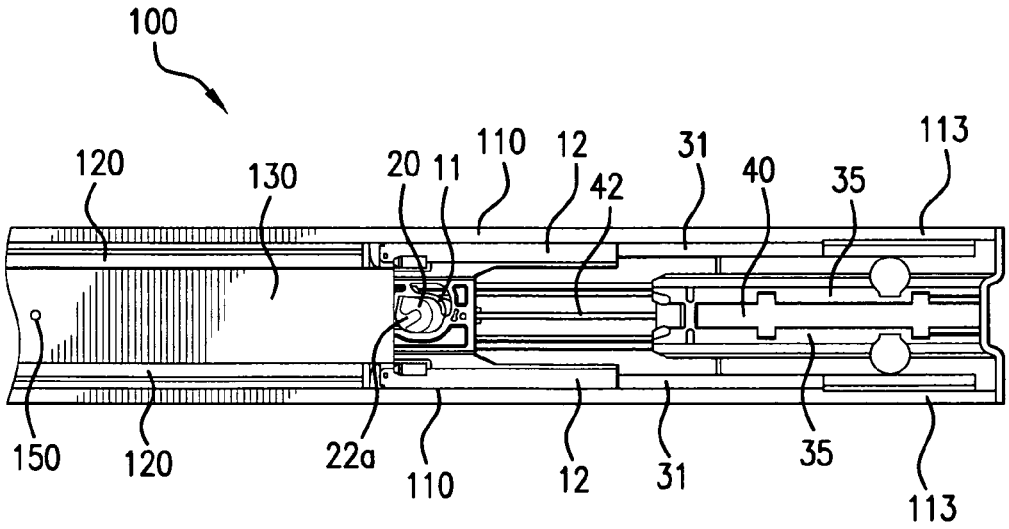
FIG. 16 is a top view of the self-closing mechanism shown in FIG. 1 when it is mounted within the cabinet member of a drawer slide.

As shown in FIG. 16, the stationary housing 30 and the slider 10 may be mounted within a cabinet member 110 of a drawer slide 100. In addition to the cabinet member 110, the drawer slide may include an intermediate member 120 and a drawer member 130. A pin 150 may be permanently affixed to the drawer member 130 so that it protrudes out from the bottom surface of the drawer member 130, i.e., into the plane of the page in FIG. 16. The pin 150 may be configured to fit through aperture 14 of the slider 10 and within the slot 22*a* of the latch 20. Moreover, the drawer member 130 may be affixed to the side of a drawer, and the cabinet member 110, having flanged lips 113, may be affixed to the sidewall of a cabinet. Thus, in the ensuing description, as the slider 10 translates along the rails 32, 33, it is guided by the spring shrouds 12 nesting on the flanged lips 113 of the cabinet member 110.

Figure 17A:
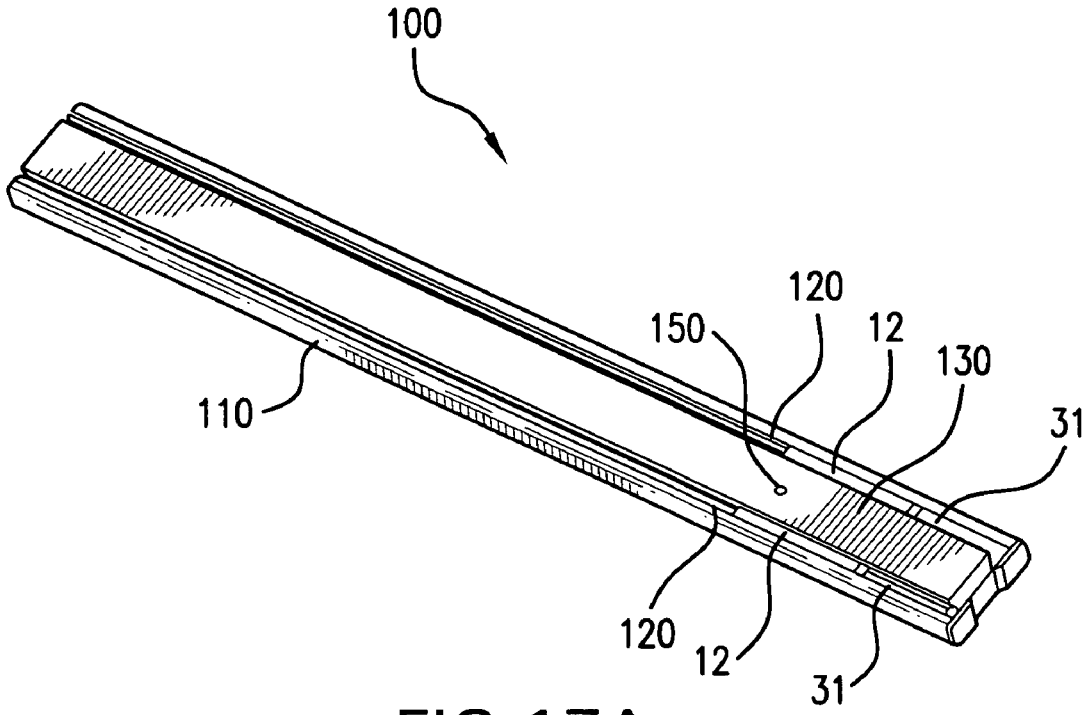
FIG. 17A is a perspective view of the top side of a drawer slide containing a self-closing mechanism in accordance with an embodiment of the invention.

In operation, the drawer slide 100 begins in a closed position, as shown in FIG. 17A. When the drawer slide 100 is in this position, the pin member 150 is positioned within the slot 22*a* of latch 20.

As the drawer to which the drawer member 130 is affixed is pulled out from the cabinet to which the cabinet member 110 is affixed, pin member 150 pulls latch 20 via slot 22*a* in the opening direction. The pin 150 is slightly off center with respect to the axis of rotation of the latch 20. Thus, pin 150 applies a rotational force (torque) to the latch 20. However, because the lower portion 24 of the latch 20 is positioned between the rails 32 and 33, and the long flat surface 24*e* of the lower portion 24 lies flat against the first rail 32, the latch 20 is not permitted to rotate. As a result, pin 150 remains within slot 22*a* and pulls latch 20, as well as slider 10, along the rails 32 and 33.

As the latch 20 reaches the recess 36 in the first rail 32, the stop edge 24*d* of the latch 20 makes contact with the rear surface 37*b* of the male component 37, which causes the latch 20 to begin to rotate in a clockwise direction. Because the rotation of the latch 20 is no longer resisted by the first rail 32, the latch 20 continues to rotate, causing the corner 24*a* to enter into the recess 36, and the triangular indent 24*b* to mate with the male component 37. In addition, the pin 150 is allowed to escape from the slot 22*a* and out through aperture 14 of the slider 10. At this point, the drawer and the drawer member 130 are allowed to freely continue to the fully open position.

The lower portion 24 of the latch 20 may be thought of as having two levels. The triangular indent 24*b* is in the lower level, while the corner 24*a* is on the upper level. Likewise, the first rail 32 can be thought of as having two levels. The male component 37 is on the lower level, while the recess 36 is in the upper level. This unique configuration allows the latch 20 to rotate when it reaches the recess 36, and the male component 37 to mate with the triangular indent 24*b* at the same time.

Until it is dislodged, the latch remains in the rotated (i.e., locked) position, with the corner 24*a* in the recess 36 and the male component 37 mated with the triangular indent 24*b*. The latch remains in this position because, as shown more clearly in FIG. 13, the curved wall 18 on the bottom side of the slider 10 presses against the long curved surface 24*c* of the latch 20 due to the spring force exerted by the retraction springs acting on the slider 10. In other words, the force of the retraction springs pulling the slider 10 in the closing direction is distributed along the long curved surface 24*c* of the latch via the curved wall 18; this force is counteracted by the front surface 37*a* of the male component 37 on the stationary housing 30. As a result, the portion of the latch 20 between the long curved surface 24*c* and the triangular indent 24*b* is "pinched" between the curved wall 18 of the slider 10 and the male component 37, preventing the slider 10 from being retracted to the closed position.

Figure 14:
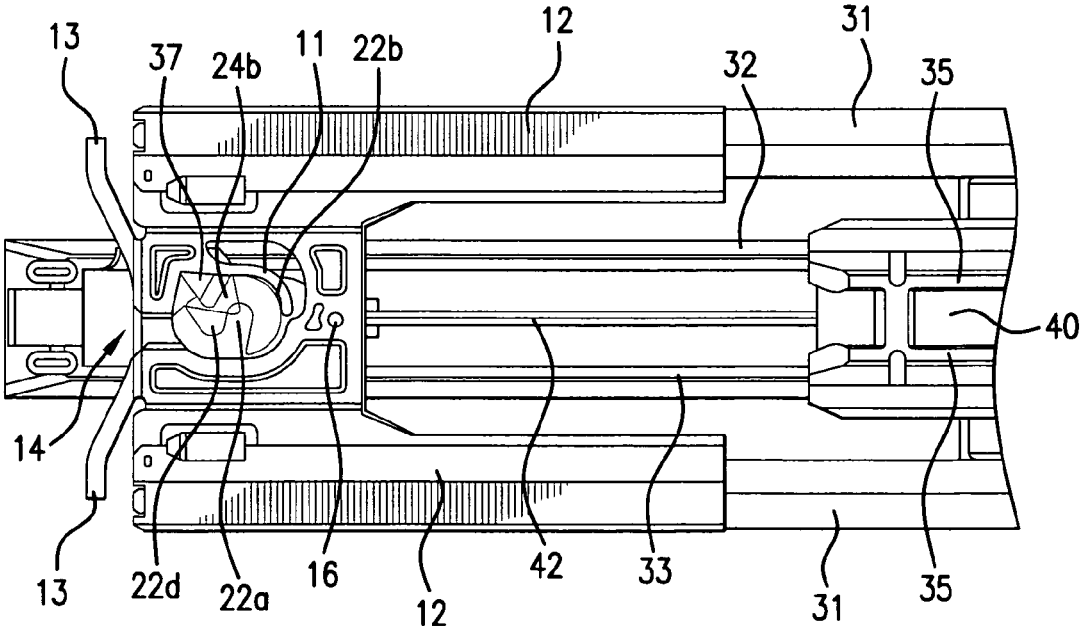
FIG. 14 is a top view of a front portion of the self-closing mechanism shown in FIG. 1 prior to the latch being released from the locked position.

When the drawer member is pushed back in the closing direction, pin 150 approaches slot 22*a* of the latch 20. Because the latch remained in the rotated position, the mouth of the slot 22*a* is substantially aligned with aperture 14 of the slider 10, allowing pin 150 to freely enter slot 22*a*. After pin 150 has entered the slot 22*a* of the latch 20, it presses against an interior surface of slot 22*a* causing the latch 20 to rotate in a counterclockwise direction, and the "pinched" portion to withdraw from between the curved wall 18 and the male component 37. Additionally, the corner 24*a* of the latch 20 is withdrawn from the recess 36 of the stationary housing 30. As shown in FIG. 14, when latch 20 rotates, so does slot 22*a* such that the lip 22*d* blocks pin 150 from leaving the slot 22*a*. As the latch 20 rotates, the curved wall 18 on the slider 10 guides the latch 20 back to the position within the slider shown in FIG. 1 so that the top portion 22 abuts the thin finger 11.

Once the latch is released from the locked position, the triangular indent 24*b* is no longer engaged with male component 37. Thus, latch 20 can no longer resist the retraction force of the springs, and slider 10 pulls pin member 150 in the closing direction via the latch 20. When damper 40 is present, the piston rod 42 of the damper 40 is connected to the slider 10, such that the closing movement of the slider 10 is dampened by the damper 40. In this way, the self closing mechanism brings the drawer slide 100 to a fully closed position in a smooth, controlled manner.

Figure 12:
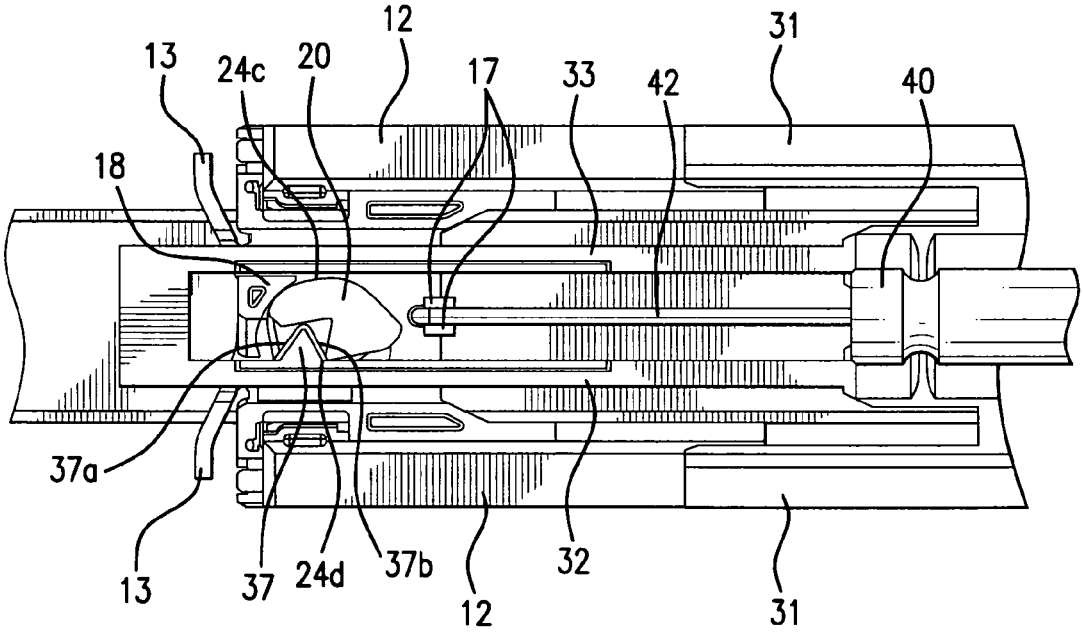
FIG. 12 is a bottom view of a front portion of the self-closing mechanism shown in FIG. 1 as it is being pulled to the open position.
Figure 13:
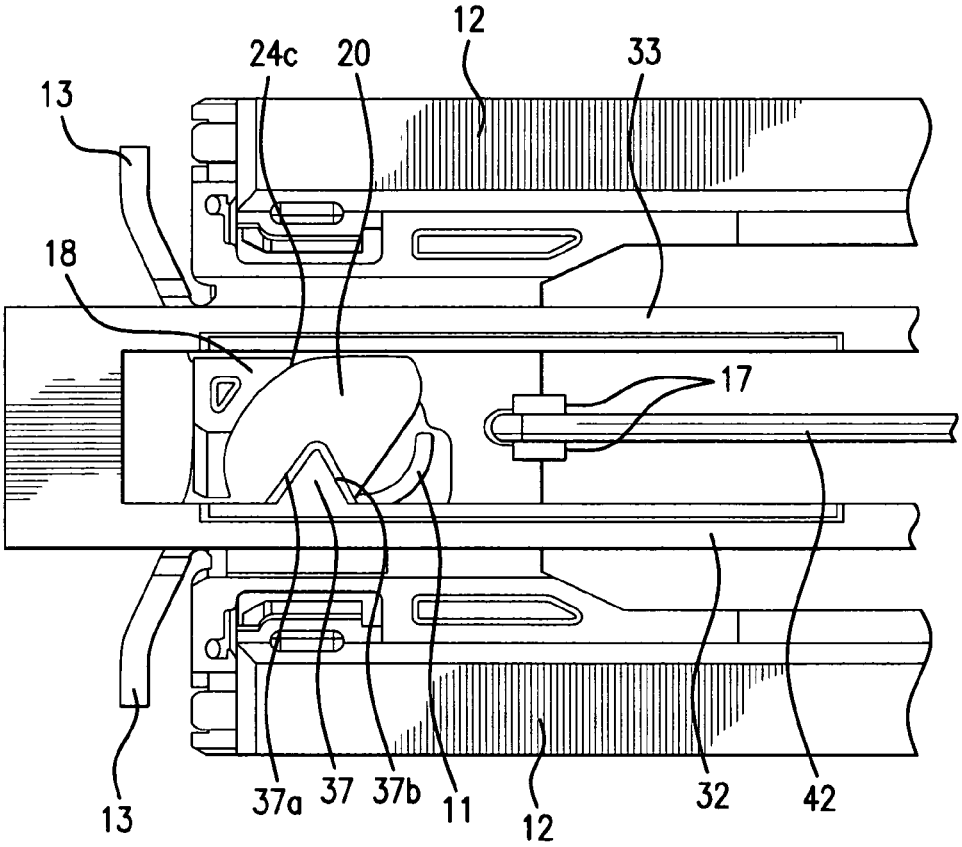
FIG. 13 is a bottom view of a front portion of the self-closing mechanism shown in FIG. 1 when it is in the open position.
Figure 15:
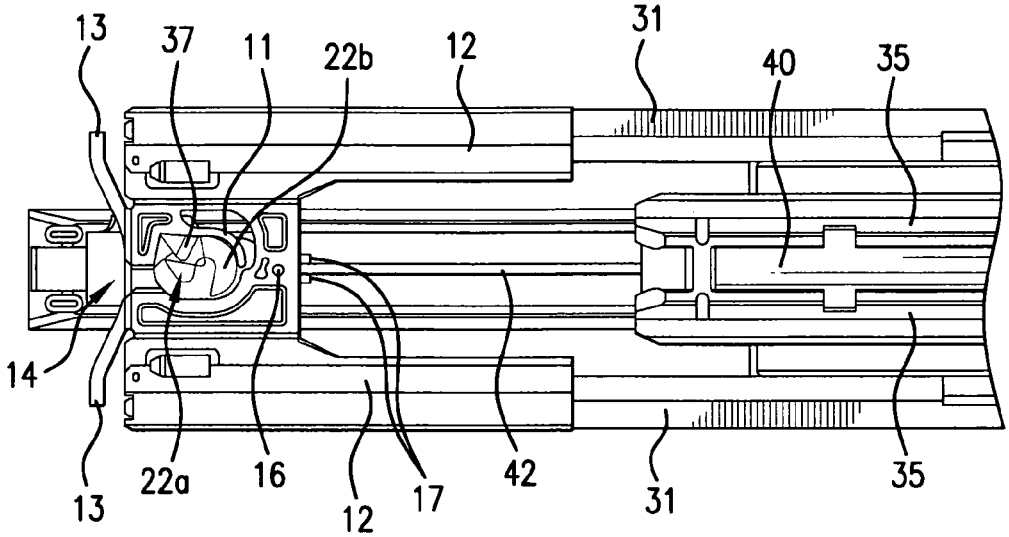
FIG. 15 is a top view of a front portion of the self-closing mechanism shown in FIG. 1 when it is in the open position.

The rotation, locking, and releasing of the latch 20 may be better understood with reference to FIGS. 12-15. FIG. 12 is a bottom view of a front portion of the self-closing mechanism shown in FIG. 1 as the drawer member is being pulled to the open position. FIG. 13 is a bottom view of a front portion of the self closing mechanism shown in FIG. 1 when the latch is in the locked position. FIG. 14 is a top view of a front portion of the self closing mechanism as the latch is being released from the locked position. FIG. 15 is a top view of a front portion of the self closing mechanism shown in FIG. 1 when the latch is in the locked position.

Although the slider 10, the latch 20, and the stationary housing 30 are configured such that the latch 20 is firmly held in place when in the locked position, the latch 20 may on occasion be inadvertently released from the locked position when the drawer slide is still in the open position. Certain embodiments of the present invention incorporate a novel reset feature to remedy this situation. As discussed earlier, the latch 20 has a ramped surface 22*c*. When the latch 20 is released from the locked position, the ramped surface 22*c* becomes aligned with the aperture 14 of the slider 10. Also, the curved wall 18 guides the latch 20 so that the top portion 22 thereof abuts the thin finger 11 on the slider 10. To "reset" the mechanism, i.e., to reinsert the pin into the slot 22*a* of the latch 20 so as to allow the pin to pull the slider to the open position the next time the drawer is pulled in the opening direction, the drawer must be pushed in to the fully closed position. When this happens, the pin 150 presses against the ramped surface 22*c*, forcing the top portion 22 of the latch 20 against the thin finger 11 on the slider 10 and the bottom portion 24 of the latch 20 against the first wall 32 on the stationary housing 30. The thin finger 11 and the first wall 32 deflect under the force of the latch 20, allowing the latch 20 to move enough to allow the pin 150 to pass over the lip 22*d* and into the slot 22*a*.

As will be understood from the above description and associated diagrams, the latch 20 must satisfy two functional requirements: (1) rotate; and (2) remain in the locked position as required. The latch 20 generally satisfies either a pre-load position, as shown, e.g., in FIGS. 18A-18D, or a locked position, as shown, e.g., in FIGS. 19A-19D. When the latch 20 is pulled to the locked position, torque is applied to the latch 20, creating a rotational tendency in the direction of the locked position. Because of this tendency to rotate, once the latch is pulled proximate the recess 36 and male component 37, the latch rotates into the locked position. As discussed below, and with reference to FIGS. 18-20, there are three kinds of forces and torques that are applied to the latch (20) when it is pulled up.

Figure 18A:
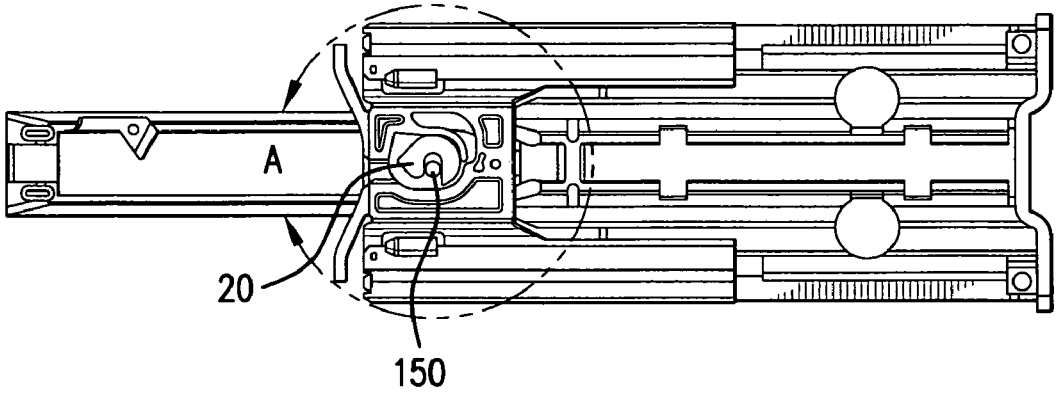
FIG. 18A is top view of a self-closing mechanism in a closed position in accordance with an embodiment of the invention.
Figure 18B:
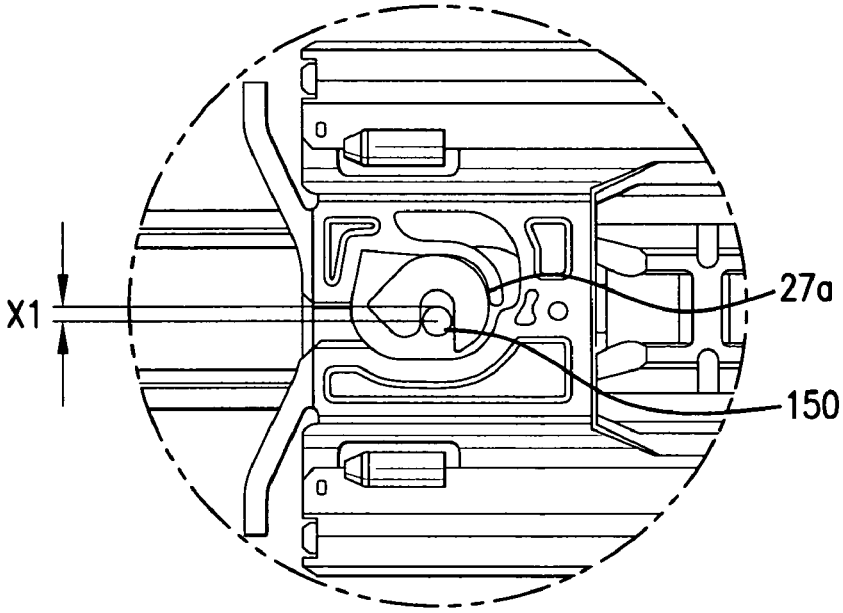
FIG. 18B is an enlarged view of the latch shown in FIG. 18A.
Figure 18C:
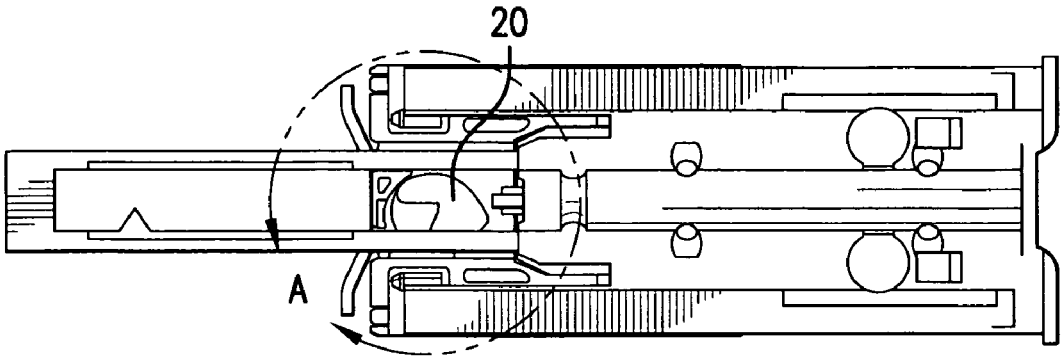
FIG. 18C is a bottom view of the self-closing mechanism shown in FIG. 18A.
Figure 18D:
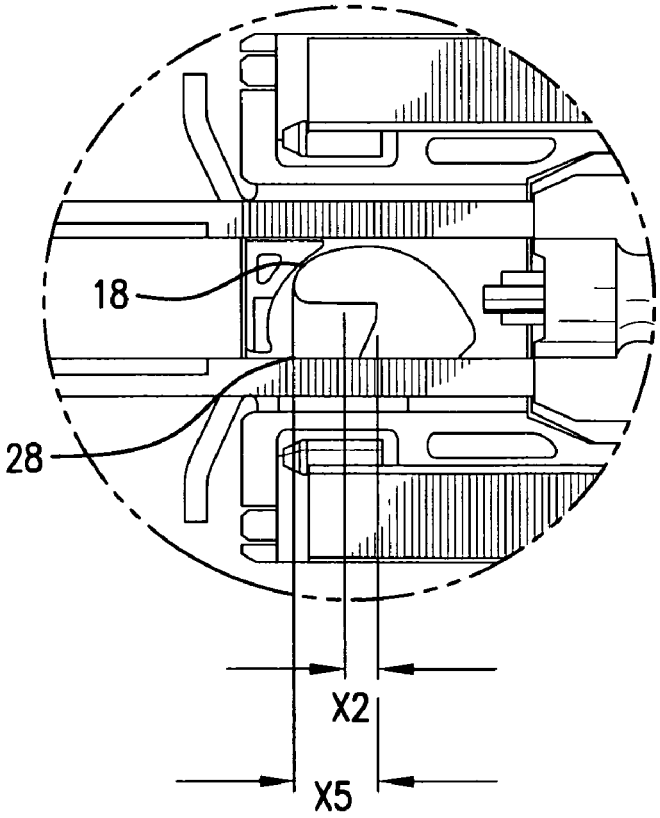
FIG. 18D is an enlarged view of the latch shown in FIG. 18C.
Figure 19A:
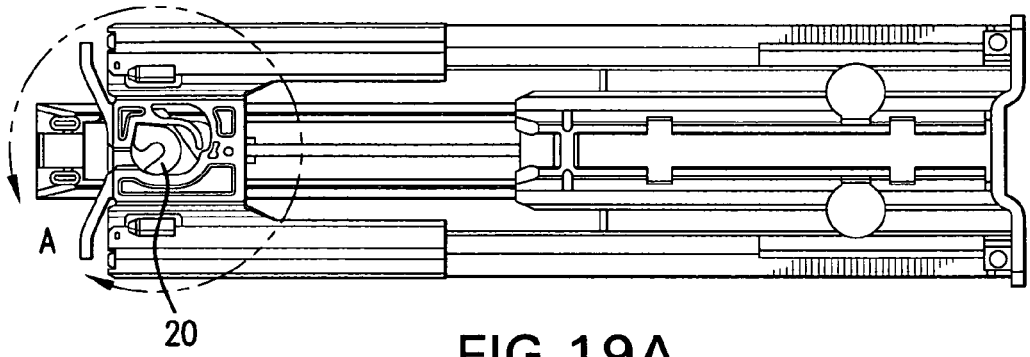
FIG. 19A is a top view of a self-closing mechanism in an open position in accordance with an embodiment of the invention.
Figure 19B:
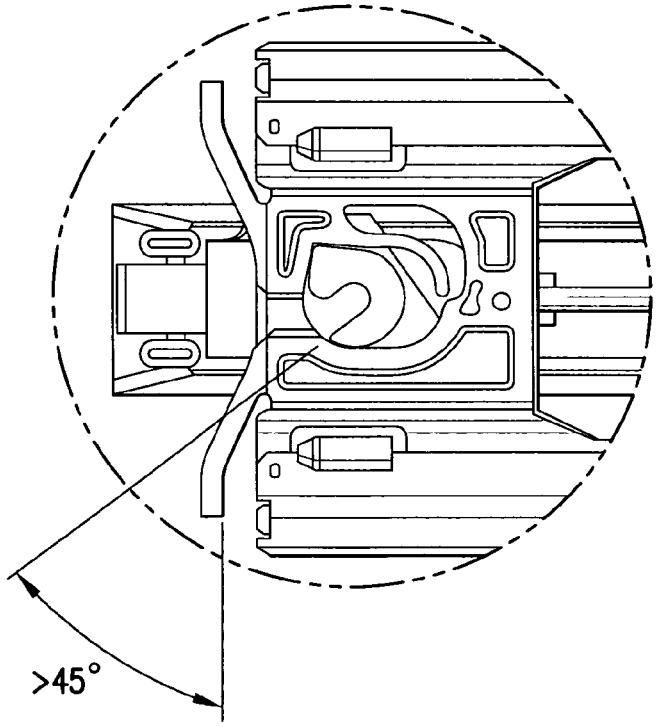
FIG. 19B is an enlarged view of the latch shown in FIG. 19A.
Figure 19C:
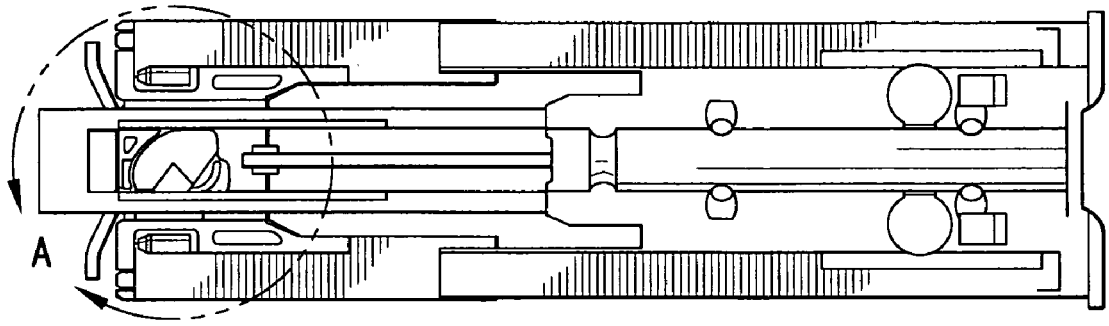
FIG. 19C is bottom view of the self-closing mechanism shown in FIG. 19A.
Figure 19D:
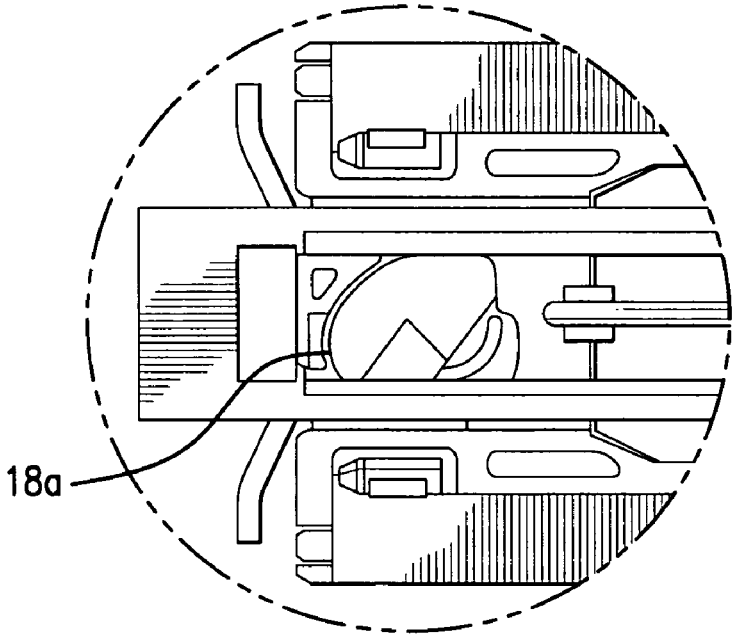
FIG. 19D is an enlarged view of the latch shown in FIG. 19C.

First, as shown in FIG. 18B, the pin 150 is offset from the center line of the assembly by an amount X1. This results in a rotational moment in the latch 20 when it is pulled by the pin 150. In addition, as shown, e.g., in FIG. 18D, the contact surface (i.e., the curved wall) 18 between latch 20 and slider 10 forms an angle, which creates a torque moment toward the direction of latching. Moreover, the pivoting circle 27*a* of the latch is offset from the locking circle 27*b* by a distance of magnitude X3 (see, e.g., FIG. 20E). As shown in FIG. 18D, this, in turn, results in contact point 28 that is offset from the center of pivot circle 27*a* by a distance of magnitude X5, thereby creating a torque moment.

Once the latch 20 is pulled up and rotated into a locked position, it must be held at that position until released again by the pin 150. As described in more detail hereinbelow, at least three factors contribute to maintaining the latch in the locked position.

Figure 20C:
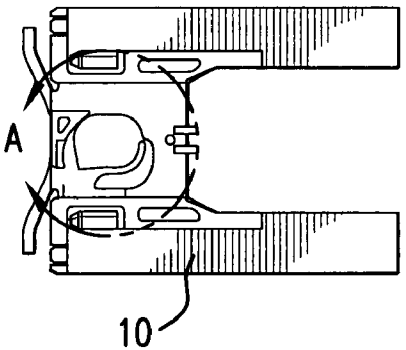
FIGS. 20A-20E show a slider and a latch from a pull-up to a locked position.
Figure 20B:
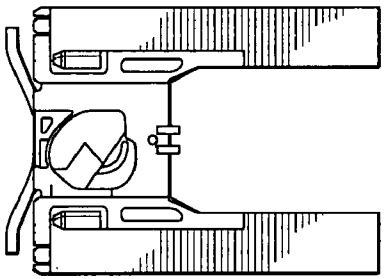
Figure 20A:
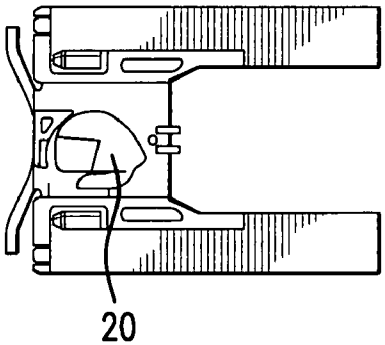
Figure 20E:
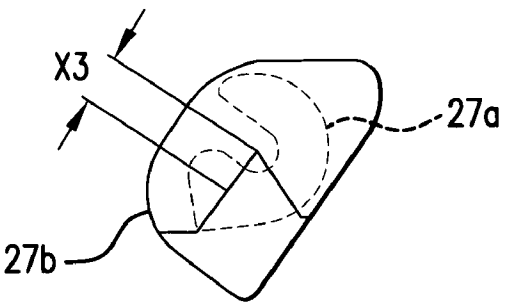
Figure 20D:
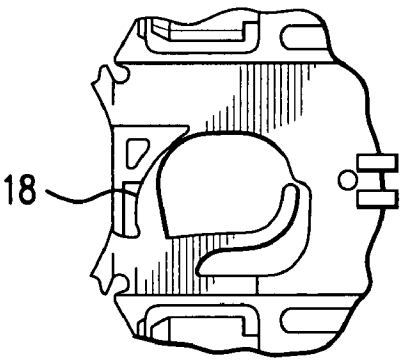
Figure 22A:
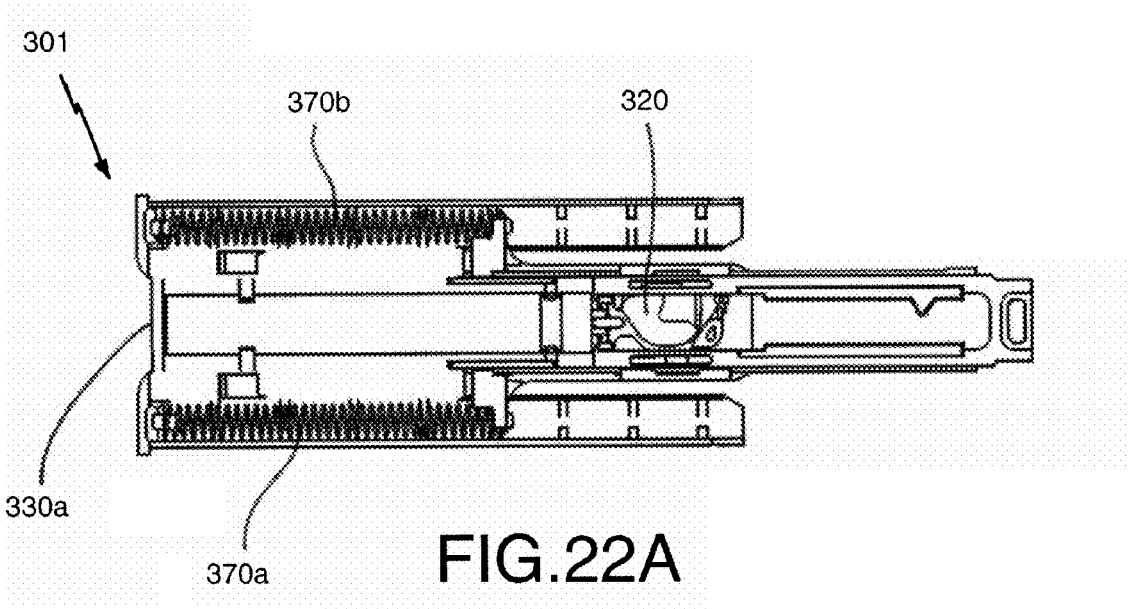
FIGS. 22A and 22B show, respectively, a bottom view and a top view of a self-closing mechanism in a closed position in accordance with an alternative embodiment of the invention.
Figure 22B:
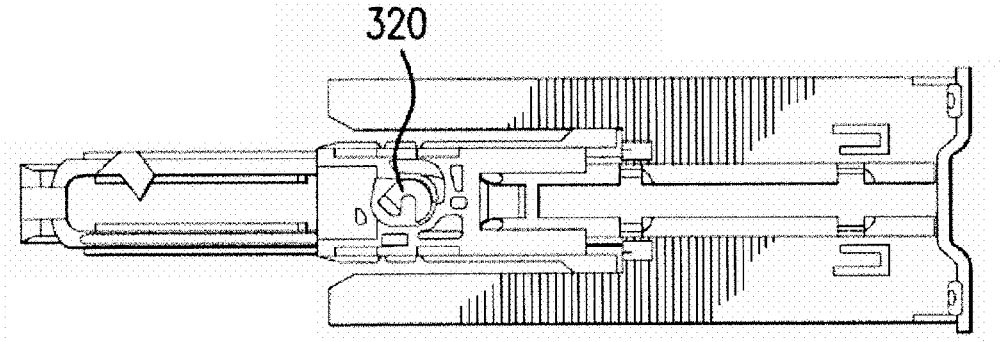
Figure 22C:
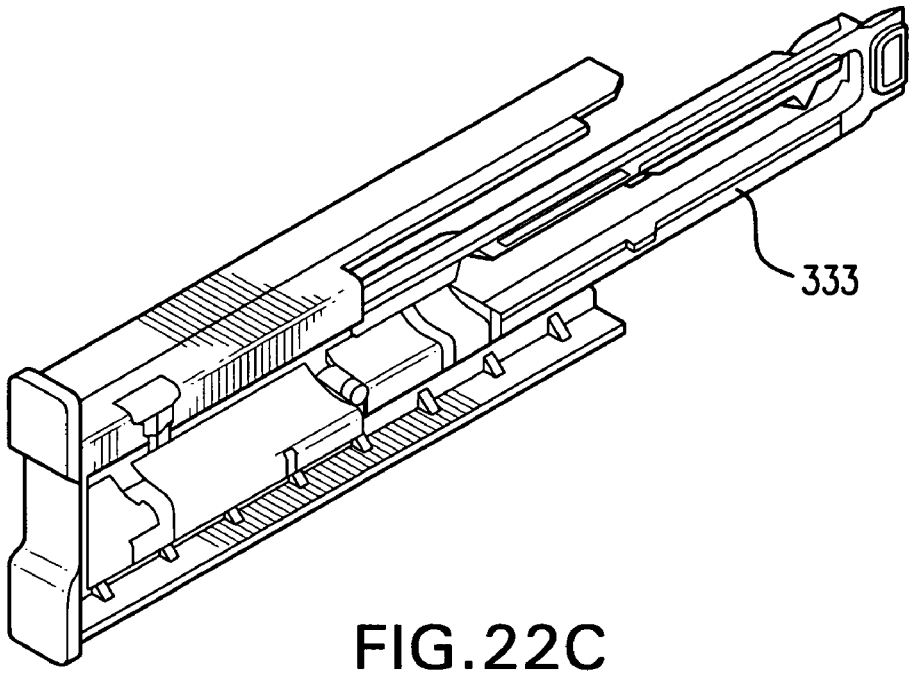
FIGS. 22C and 22D show, respectively, a bottom perspective view and a top perspective view of a housing in accordance with an embodiment of the invention.
Figure 22D:
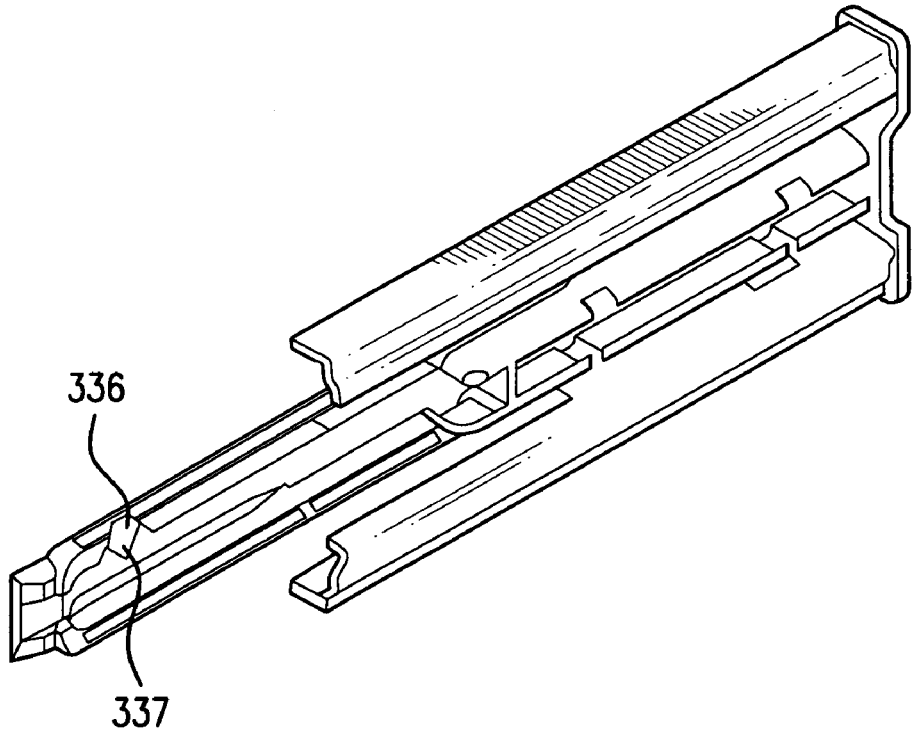

First, as shown, e.g., in FIG. 20E, the pivoting (rotating) circle 27*a* is offset from the locking circle 27*b* by a distance having magnitude X3. Because the spring force is parallel to the center line of the assembly and offset from the center of the pivoting circle 27*a*, it creates a locking moment to the latch. In addition, the rotational angle of the latch is larger than 45°, and may be, e.g., 55°, which results in a "holding" moment at that position. Moreover, the contact surface 18*a* between the slider and the latch has curves in a direction that favors locking.

As is evident from the above description, in embodiments of the invention, two parallel springs are connected symmetrically to both sides of the slider 10, which pushes down the latch 20. With this configuration, the direction of spring force is along the center line of the assembly. Therefore, retention of the latch in (the locked) position is dependent upon the offsets on the latch and the slider, as well as the forces involved, as described hereinabove.

For example, the center of pivot circle 27*a* on the latch 20 is always along the same line which may be, e.g., 0.030-0.050 inch offset from the center line of the assembly. See X1 in FIG. 18B. The locking circle 27*b* swings away from this line and then pushed down by the contact surface on the slider.

Since the two springs are mounted symmetrically to opposing sides of the slider 10 and away from the latch 20, all of the components relating to locking/unlocking are on the running track of the latch and along the center line of the assembly. This allows the latching mechanism to be minimized and completely hidden underneath the drawer member 130 (or the drawer member can be extended all the way to the back end of the housing 30). Similarly, the locking mechanism can be completely underneath intermediate member 120 (or the intermediate member can be extended all the way to the front end of the slider). This is advantageous because the drawer can be pulled out further if the cabinet and/or intermediate members are allowed to be extended further.

In certain embodiments, the slider 10 includes impact fingers 13. When the slide is being closed (i.e., when the intermediate member is traveling inwards), it is possible for the intermediate member 120 to ram against the front of the slider 10. The impact fingers 13 may be flexible and may be placed so that they not only restrict the inward travel of the intermediate member 120, but also absorb its impact. This may help prevent the self closing mechanism from becoming damaged or malfunctioning due to excessive and/or repeated jarring.

Figure 17B:
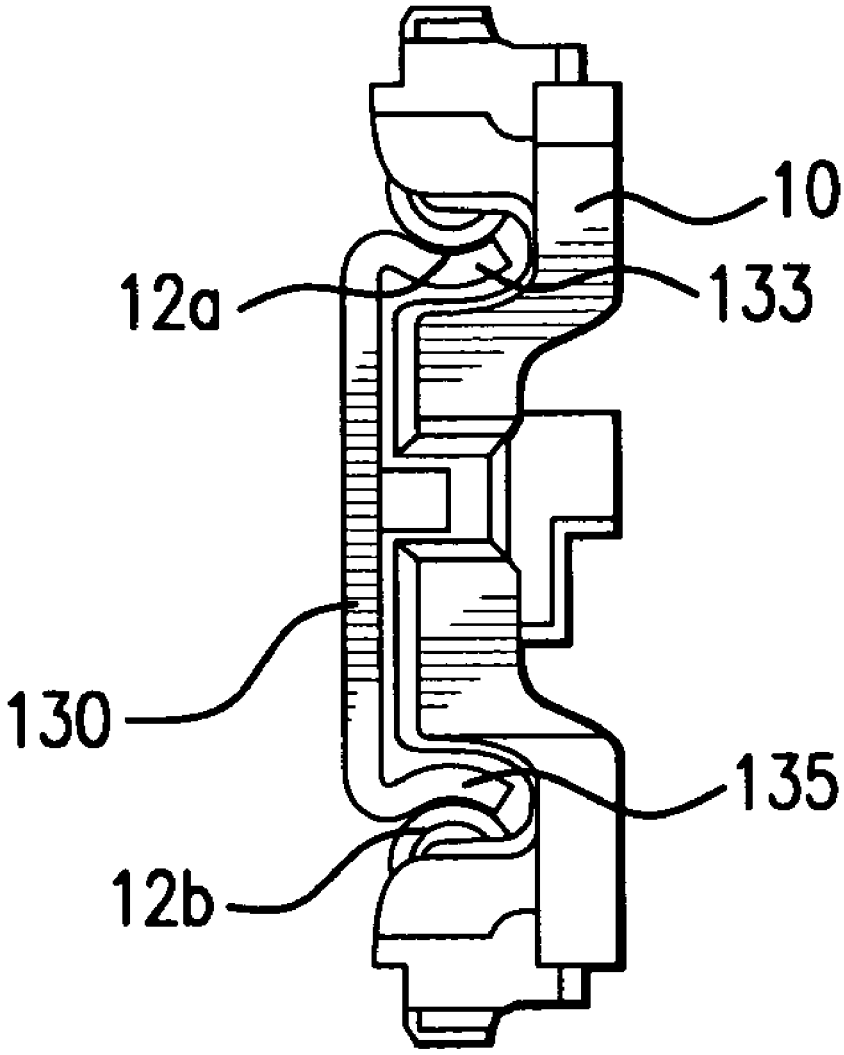
FIG. 17B is a vertical cross-section showing the interaction of a slider and a drawer member in accordance with an embodiment of the invention.

In embodiments of the invention, the slider 10 also includes guide members 12*a*, 12*b* which are symmetrically disposed on the spring shrouds 12 (see, e.g., FIGS. 5 and 17B). As shown in these figures, the guide members 12*a*, 12*b* are generally convex, and mate with concave flanges 133, 135 of the drawer member 130. In operation, as the drawer member 130 travels towards the drawer-closed position, and just prior to engaging the latch 20 via the pin 150, guide member 12*a* mates with flange 133, and guide member 12*b* mates with flange 135. This allows the drawer member 130 to maintain its relationship with the slider 10 during the engagement and movement towards the closed position and helps prevent disengagement of the pin 150 from the latch.

According to certain embodiments, the self closing mechanism may be assembled as a sub-assembly, and may be self-contained before being installed into the slide. The placement and geometry of the stationary spring shrouds 31 on the stationary housing 30 may prevent the springs from being unhooked/detached once connected to the stationary housing 30. The springs may be attached to spring posts or hooks on the slider, or may be melded to the slider. The slider spring shrouds may prevent debris from damaging the springs. The latch 20 may then be inserted into the space between the aperture 14 and the thin finger 11 in the slider 10.

In certain embodiments, the self closing mechanism of the present invention may have a low profile such that when it is installed into a slide, the drawer member 130 and intermediate member 120 can slide over certain components of the self closing mechanism. Specifically, the drawer member 130 can slide over the body portion of the slider 10 and the stationary housing 30, while the intermediate member 120 can slide over the portion of the first and second rails which extends out from the body portion of the stationary housing. Thus, as shown in FIG. 17A, when the drawer slide 100 is in the fully closed position, with the exception of the spring shrouds 12 of the slider 10 and spring shrouds 31 of the stationary housing 30, the self closing mechanism 1 is almost completely hidden from view. Allowing the drawer member and intermediate member to slide over certain components of the self closing mechanism gives the slide extra strength and load carrying capacity.

Figure 21:
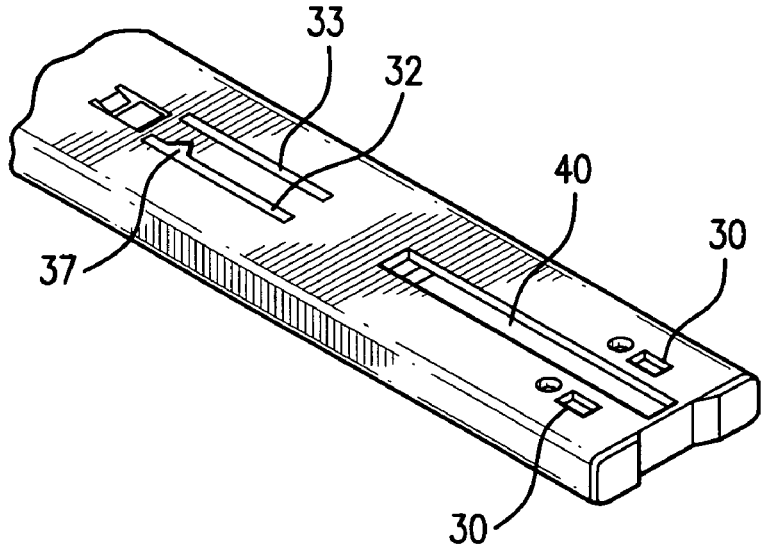
FIG. 21 is a perspective view of the bottom side of the drawer slide shown in FIG. 17A.

In certain embodiments, the bottom of the cabinet member 110 may include cutouts as shown in FIG. 21. These cutouts may provide more room for the damper 40 and other components of the self closing mechanism such as the first and second rails 32 and 33. This allows these components to have more mass and strength while maintaining a lower profile. In addition, without cutouts, the profile of the self closing mechanism may be too large to allow the drawer and intermediate members to slide over it. It is noted that, in the embodiment shown in FIG. 21, the cutouts also serve to secure portions of the housing—e.g., the rails 32, 33—to the cabinet member 110. Nevertheless, in embodiments of the invention, the housing 30, and/or portions thereof, may be secured to the slide members, including the cabinet member 110, by other means, such as, e.g., by one or more rivets.

Figure 25:
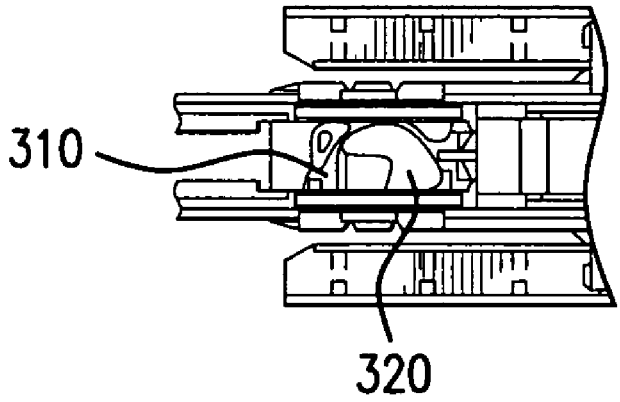
FIG. 25 is an enlarged bottom view of the latch shown in FIG. 22A.
Figure 26:
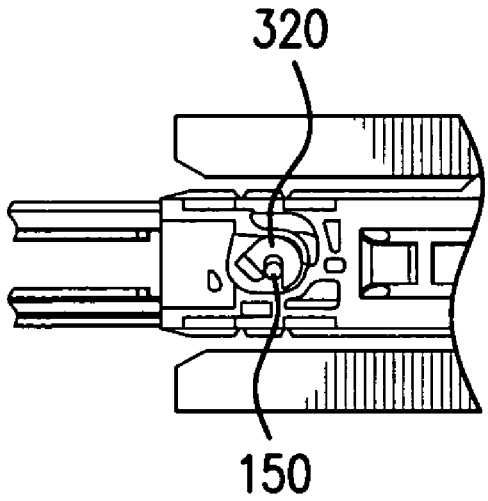
FIG. 26 is an enlarged top view of the latch shown in FIG. 22B.
Figure 27:
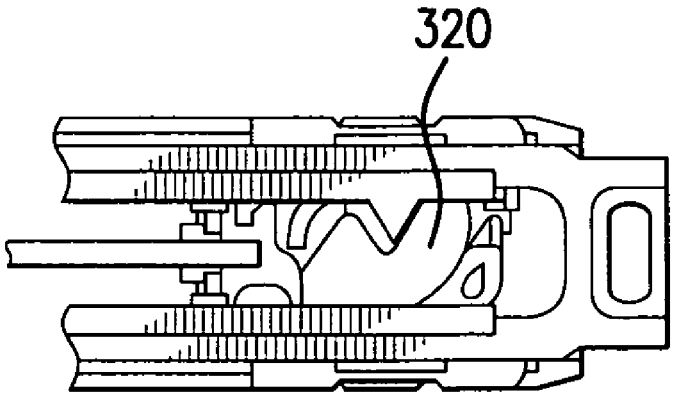
FIG. 27 is an enlarged bottom view of the latch shown in FIG. 24B.
Figure 28:
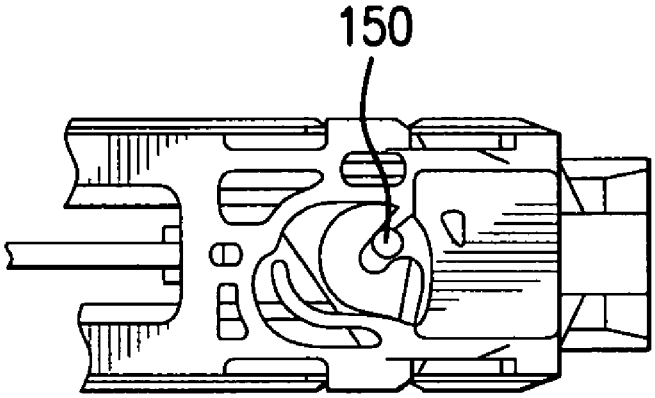
FIG. 28 is an enlarged top view of the latch shown in FIG. 24A.

An alternative embodiment of the self-closing mechanism is shown in FIGS. 22-31. FIG. 22A shows a bottom view, and FIG. 22B shows a top view, of the self-closing mechanism 301 in the drawer-closed position, with the latch 320 open. FIGS. 23A and 23B show, respectively, top and bottom views of the self-closing mechanism 301 coupled to the cabinet member 110 and in the drawer-closed position. FIG. 23C shows a top view of the intermediate member 3120 as it is traveling inwards (i.e., in the drawer-closed position), and FIG. 23D shows a top view of the intermediate member 3120 in the closed position, and the drawer member 130 as it is traveling inwards. FIGS. 24A and 24B show, respectively, top and bottom views of the self-closing mechanism 301 in the drawer-open position, with the latch 320 in the locked position. FIG. 25 shows an enlarged bottom view of the latch 320 and slider 310 in the drawer-closed position. FIG. 26 shows an enlarged top view of the latch 320 and slider 310 in the drawer-closed position. FIG. 27 shows an enlarged bottom view of the latch 320 and slider 310 in the drawer-open position, with the latch 320 in the locked position and the pin 150 about to exit the latch. FIG. 28 shows an enlarged top view of the latch 320 and slider 310 in the drawer-open position, with the latch 320 in the locked position and the pin 150 about to exit the latch. Thus, in the alternative embodiment, the self-closing mechanism includes a stationary housing 330, a latch 320, and a slider 310, and may include a damping mechanism, such as, e.g., the damper 40 described previously.

Figure 29A:
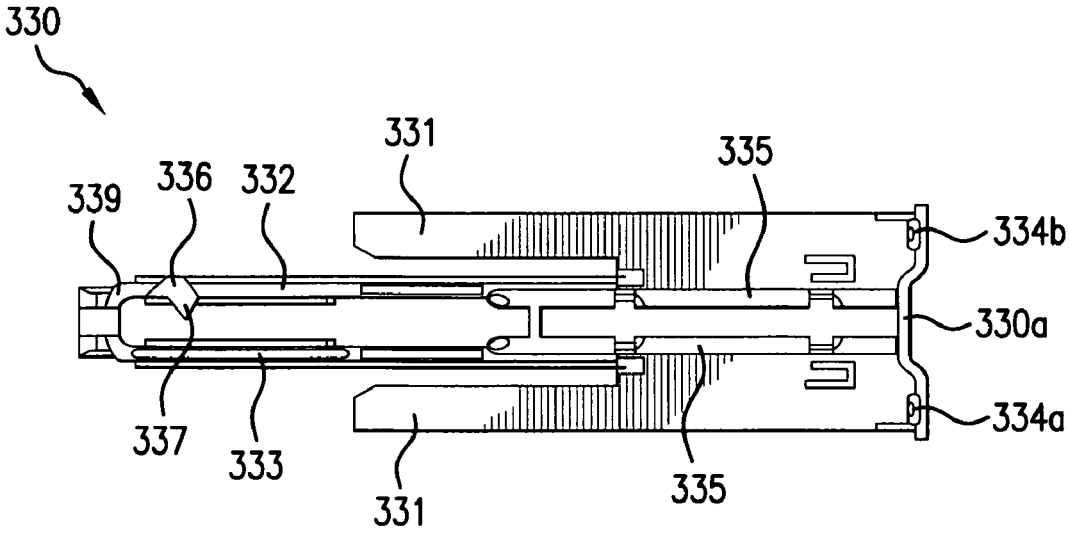
FIGS. 29A and 29B show, respectively, a top view and a bottom view of the housing shown in FIGS. 22-24.
Figure 29B:
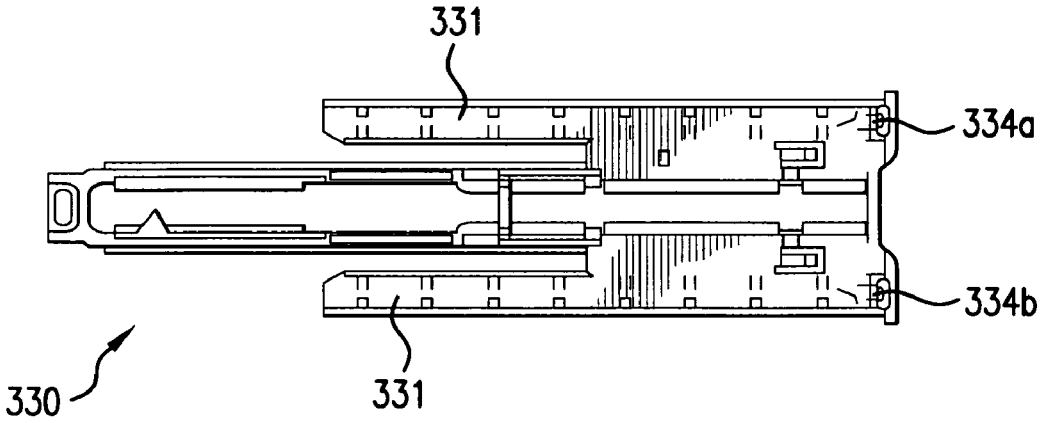

As shown in FIGS. 29A and 29B, the stationary housing 330 is substantially similar to the stationary housing 30 shown, e.g., in FIGS. 9-11. Thus, stationary housing 330 includes stationary spring shrouds 331, a first rail 332, a second rail 333 that is parallel to, and laterally spaced from, the first rail 332, spring posts 334*a*, 334*b* disposed proximate the rear (or back) end 330*a* of the housing 330, a recess 336 in the first rail 332, and a male component 337 that protrudes laterally from the first rail 332 towards the second rail 333. Similar to the embodiments of, e.g., FIGS. 9-11, the male component 337 has a front surface and a rear surface which, in embodiments of the invention, may include a ramped portion (see FIG. 11). In addition, in embodiments that include a damping mechanism, the housing 330 may include support structure for the damping mechanism. Thus, when, e.g., a cylindrical damper 40 is employed, the housing 330 may also include damper supports 335 for holding the damper 40 in place.

Figure 30A:
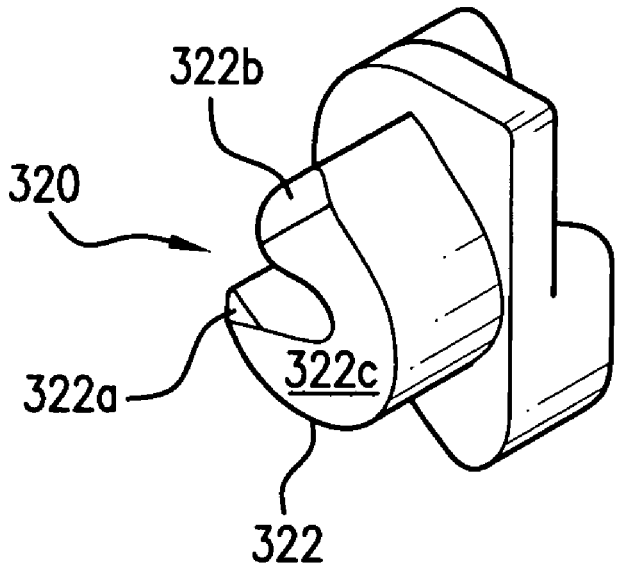
FIG. 30A is a top perspective view of a latch in accordance with an embodiment of the invention.
Figure 30B:
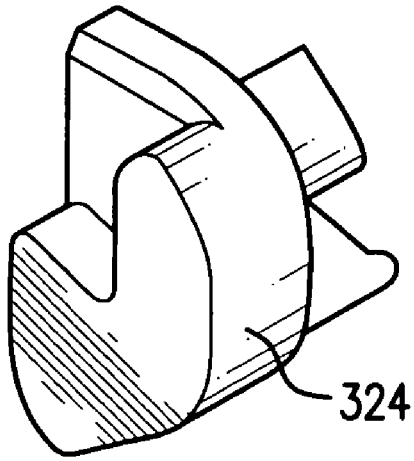
FIG. 30B is a bottom perspective view of the latch shown in FIG. 30A.

FIGS. 30A and 30B show a latch 320 which has substantially the same structure and characteristics as the latch 20 shown, e.g., in FIGS. 7 and 8. However, as shown in the figures, in this embodiment, the latch 320, having a top (or upper) portion 322 and a bottom (or lower) portion 324, may further include ramps 322*a*, 322*b* on the upper surface 322*c* of the top portion 322.

Figure 31A:
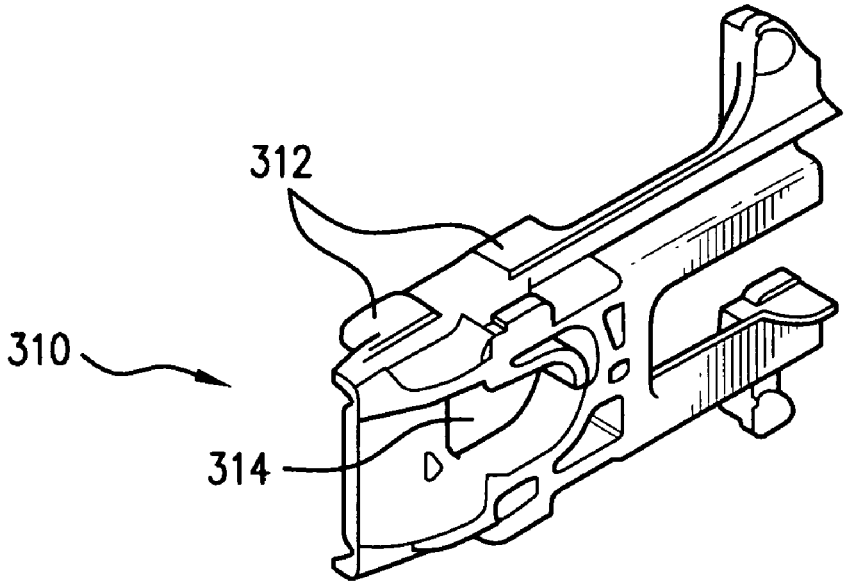
FIG. 31A is a top perspective view of a slider in accordance with an embodiment of the invention.
Figure 31B:
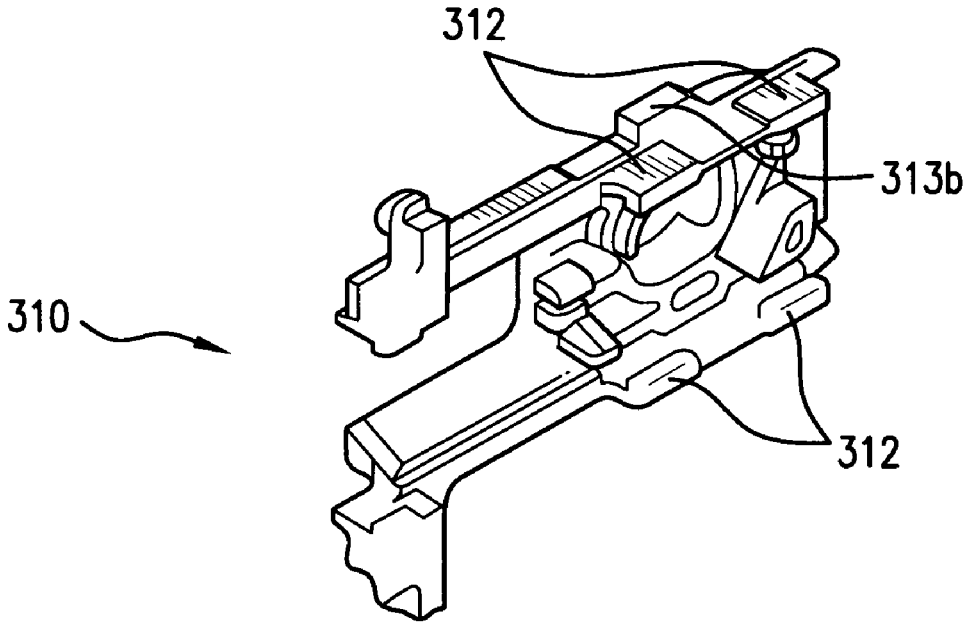
FIG. 31B is a bottom perspective view of the slider shown in FIG. 31A.
Figure 31C:
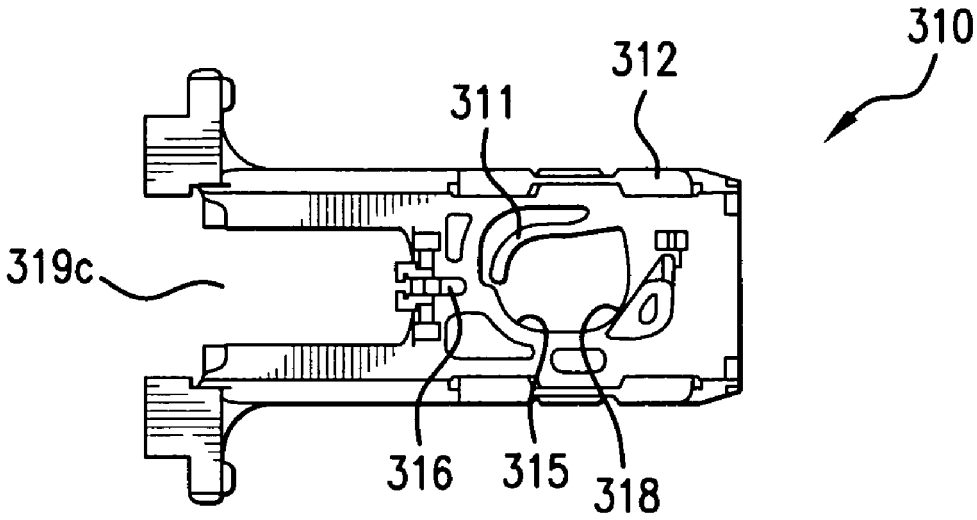
FIG. 31C is a bottom plan view of the slider shown in FIG. 31A.
Figure 31D:
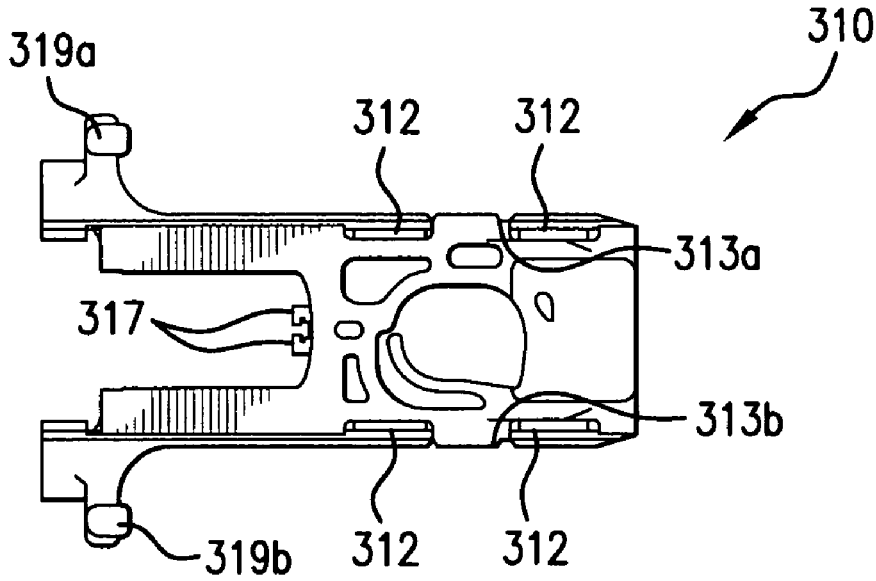
FIG. 31D is a top plan view of the slider shown in FIG. 31A.
Figure 31E:
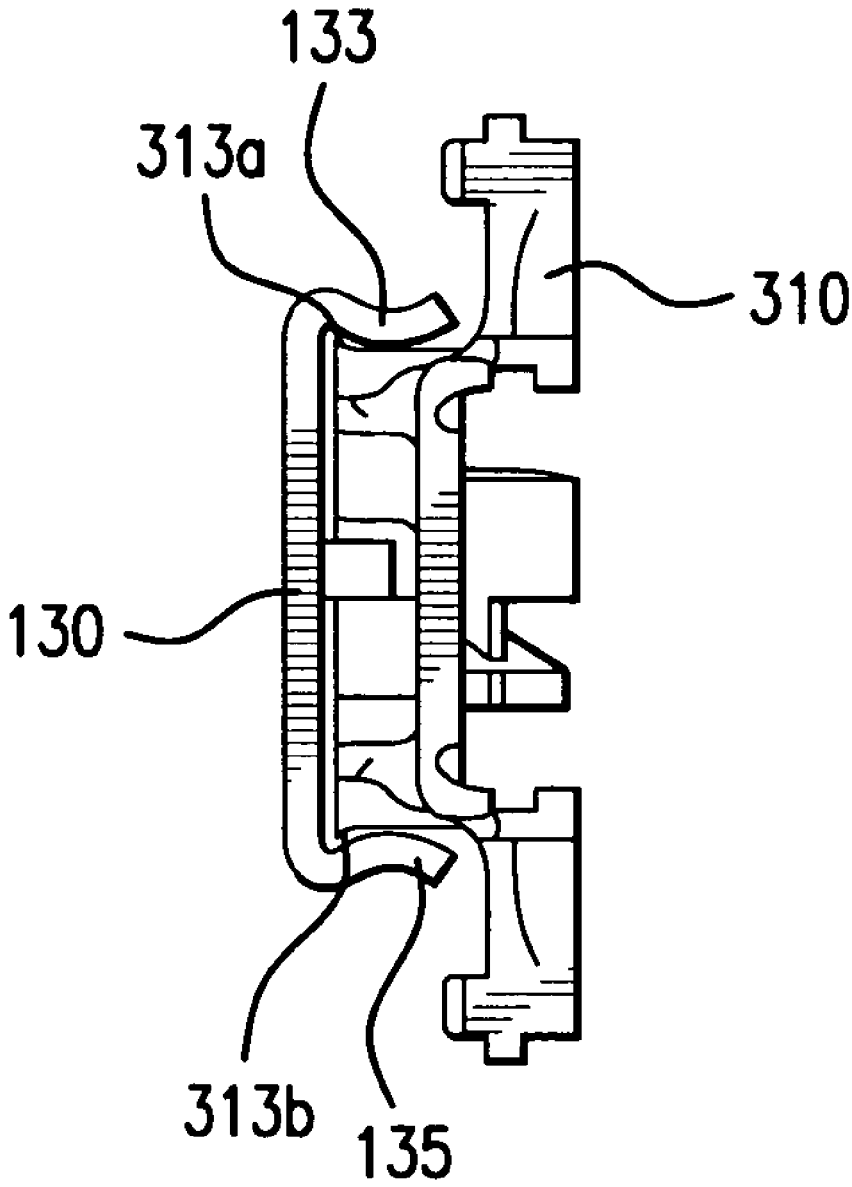
FIG. 31E is a vertical cross-section showing the interaction of a drawer member with the slider shown in FIG. 31A.

FIGS. 31A and 31B show perspective views, while FIG. 31C shows a bottom view, and FIG. 31D shows a top view, of the slider 310 in accordance with an embodiment of the present embodiment. As will be seen from FIGS. 31A-31D, the slider 310 includes a majority of the structural elements of the slider 10 shown, e.g., in FIGS. 5 and 6. Thus, for example, the slider 310 includes a thin finger 311, an arcuate inner surface 315, a hole 316, and rod supports 317. Thus, the slider's interaction with the latch 320, the housing 330, and, when present, a damping mechanism may be very much similar to that described above in connection with the slider 10, the latch 20, the housing 30, and, e.g., the damper 40. Nevertheless, as described hereinbelow, the slider 310 is structurally different from slider 10 in certain respects.

The slider 310 includes spring posts 319*a* and 319*b*, which, in contrast to the structure of the slider 10, extend upwards and proximate the rear (or back) end 319*c* of the slider 310. With this configuration, a first spring 370*a* is coupled to slider spring post 319*a* and housing spring post 334*a* at its respective ends. See, e.g., FIGS. 22A and 24B. Similarly, a second spring 370*b* is coupled to slider spring post 319*b* and housing spring post 334*b* at its respective ends. As shown, for example, in FIGS. 24A and 24B, when the slider 310 is farthest away from the back end 330*a* of the housing (i.e., when the latch 320 is in the locked position), the spring posts 319*a* and 319*b* are positioned just at or near the front end 331*b* of the stationary housing's spring shrouds 331. As such, the front ends of the parallel springs never extend beyond the respective front ends 331*b* of the spring shrouds 331. This, in turn, allows for elimination of the slider spring shrouds 12 in the slider 310.

Figure 32:
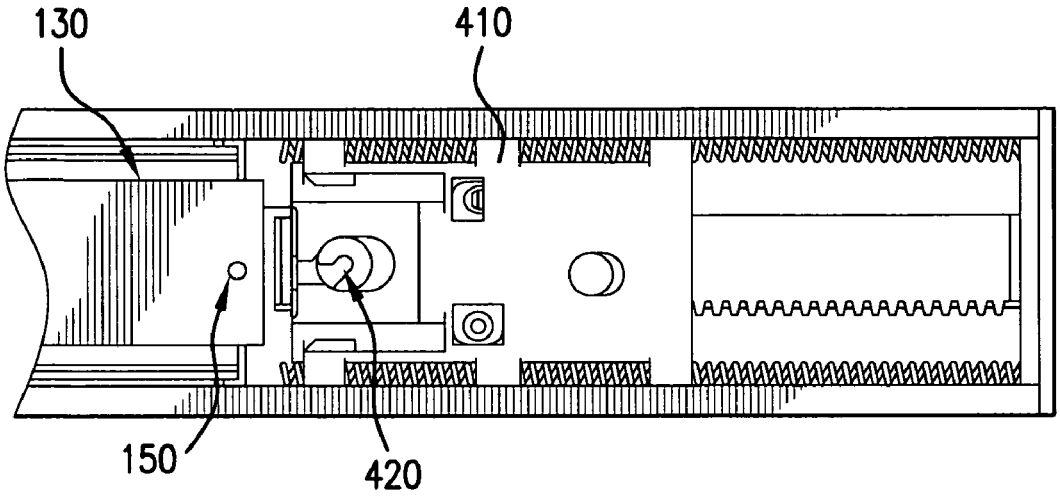
FIG. 32 is a top view of a self-closing mechanism in accordance with an alternative embodiment of the invention.
Figure 33:
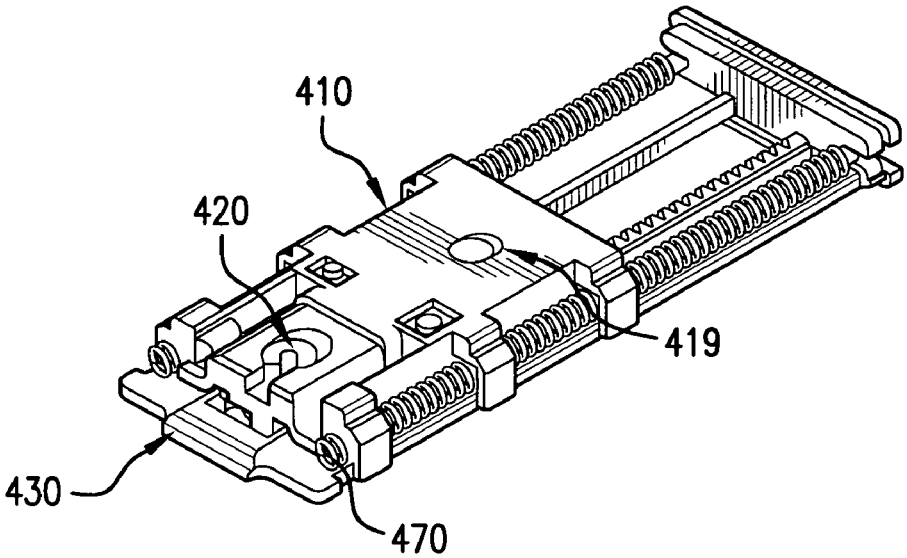
FIG. 33 is a perspective view of the self-closing mechanism shown in FIG. 32.
Figure 34:
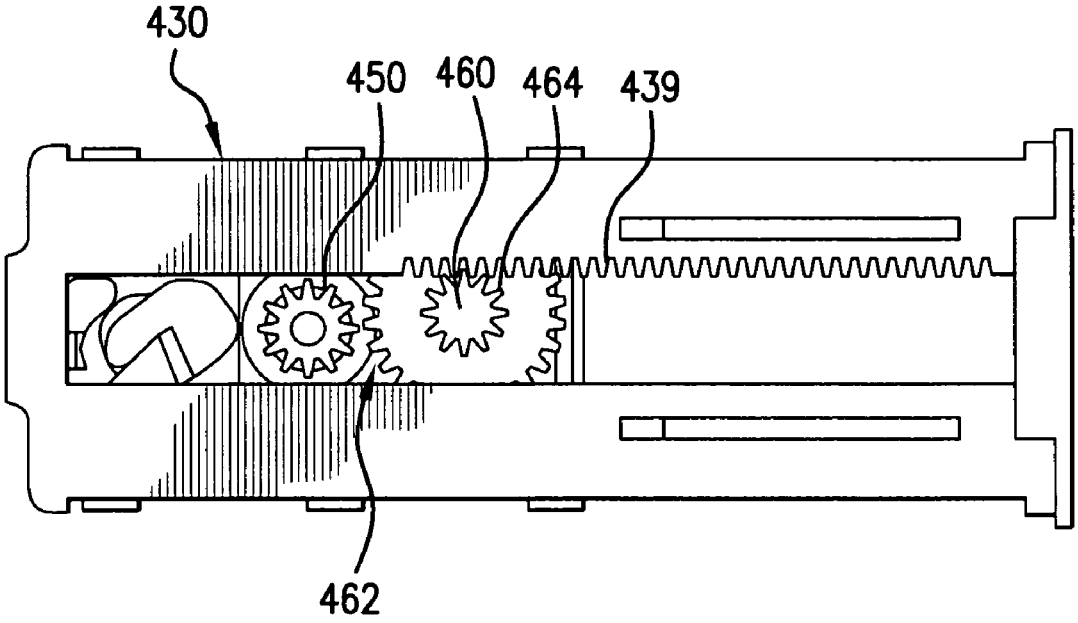
FIG. 34 is a bottom view of the self-closing mechanism shown in FIG. 32, with a rotary gear and an idle gear about to engage one another.
Figure 35:
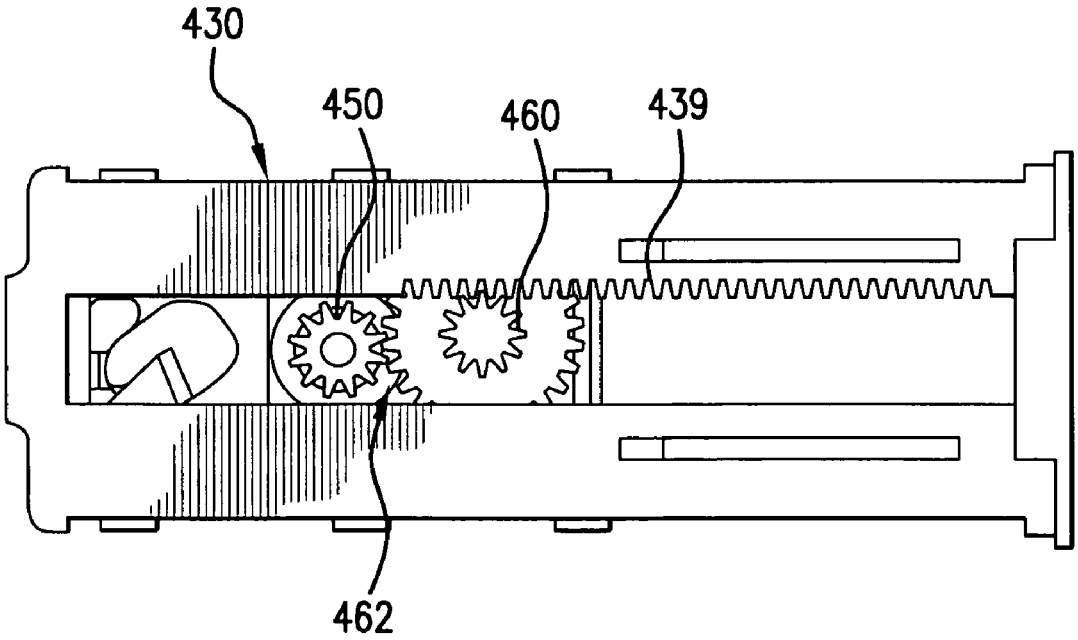
FIG. 35 is a bottom view of the self-closing mechanism shown in FIG. 32, with a rotary gear and an idle gear in the engaged position.
Figure 36:
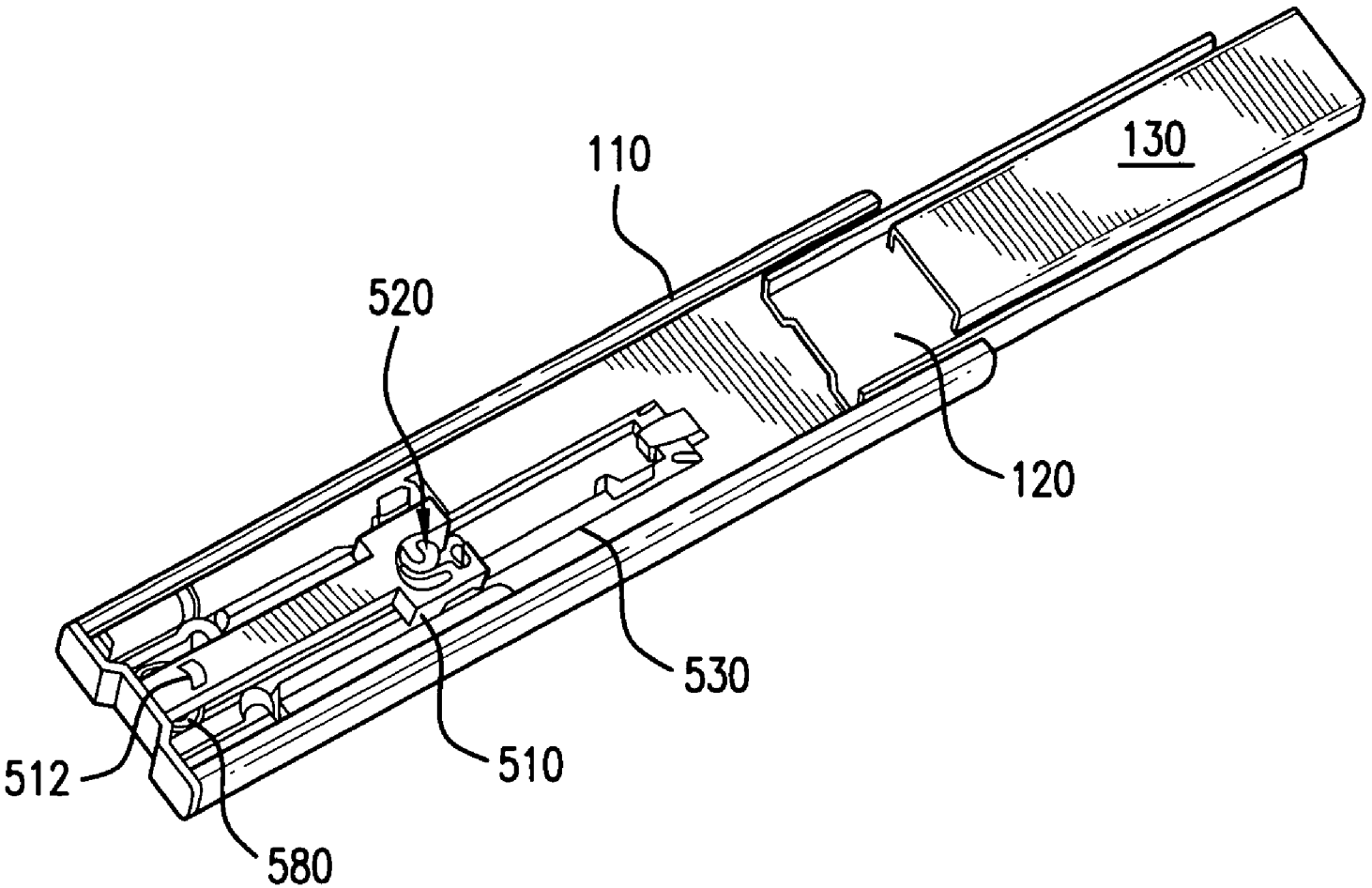
FIG. 36 is a perspective view of a self-closing mechanism in accordance with another alternative embodiment of the invention.
Figure 37:
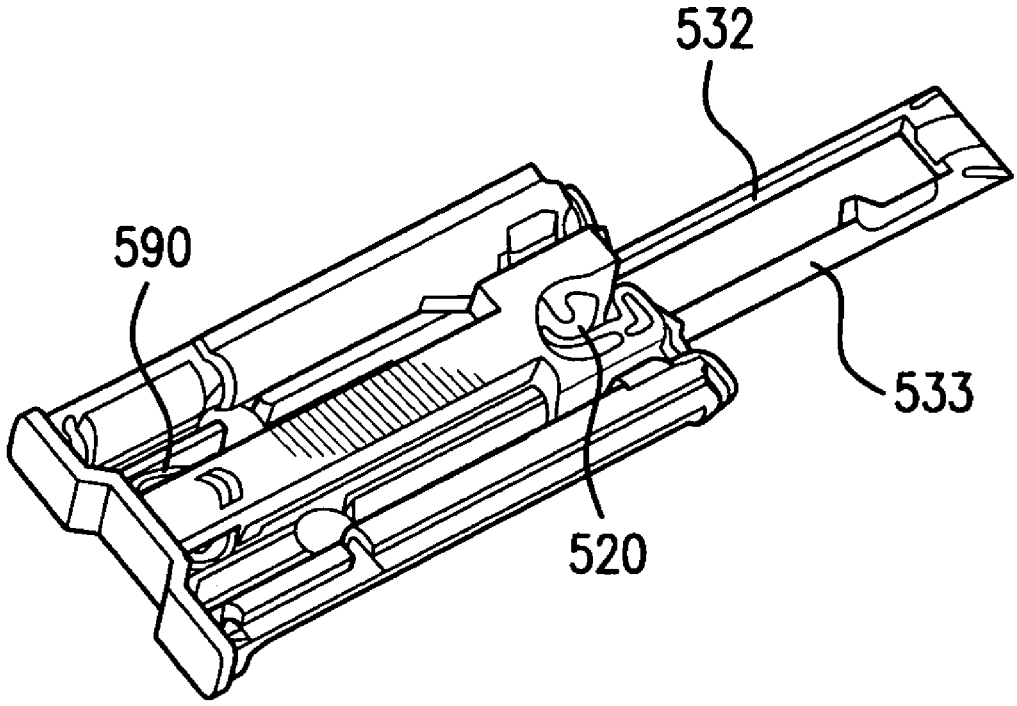
FIG. 37 is an enlarged view of the self-closing mechanism shown in FIG. 36.
Figure 38:
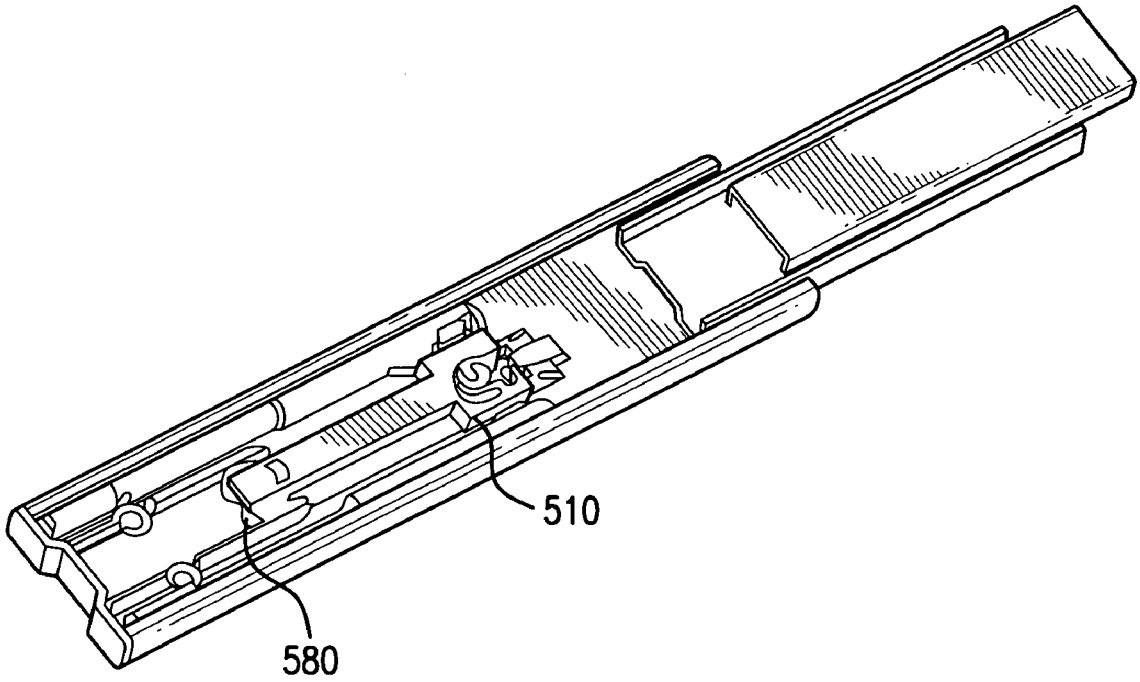
FIG. 38 is a perspective view of the self-closing mechanism of FIG. 36 in the open position.
Figure 39:
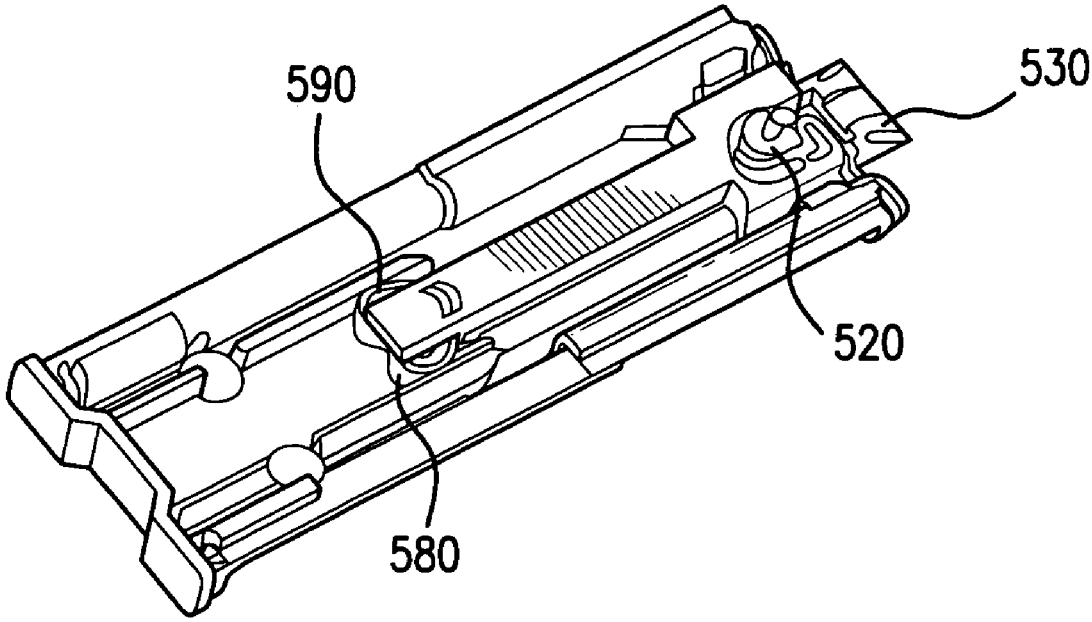
FIG. 39 is an enlarged view of the self-closing mechanism shown in FIG. 38.
Figure 40:
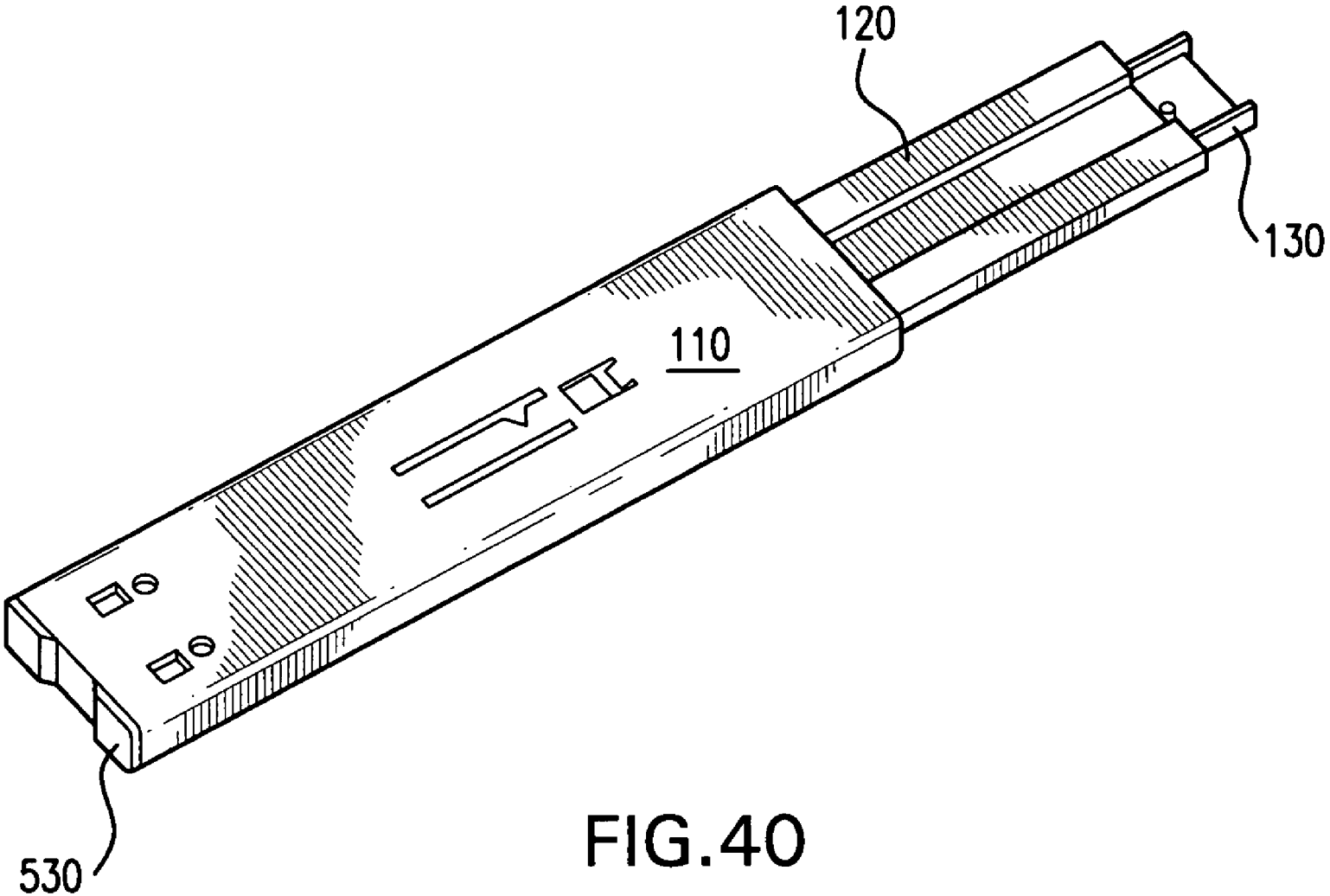
FIG. 40 is a bottom view, including an outer member, an inner member, and an intermediate member.
Figure 41:
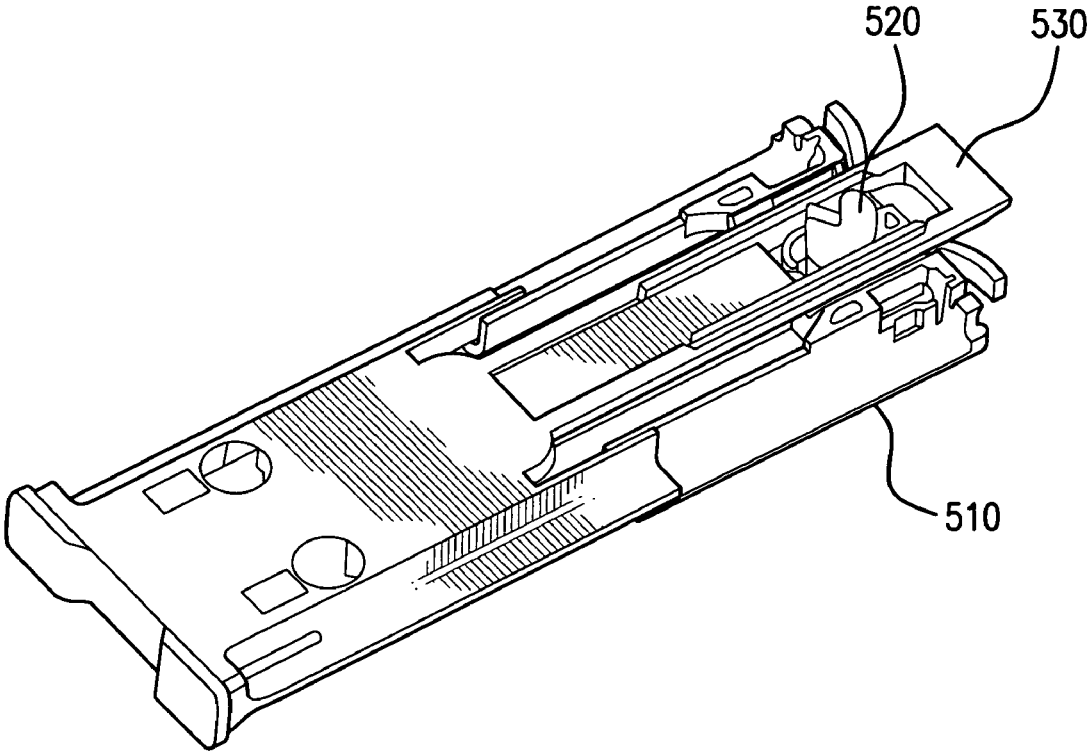
FIG. 41 is a perspective view of the self-closing mechanism in the locked position.
Figure 42:
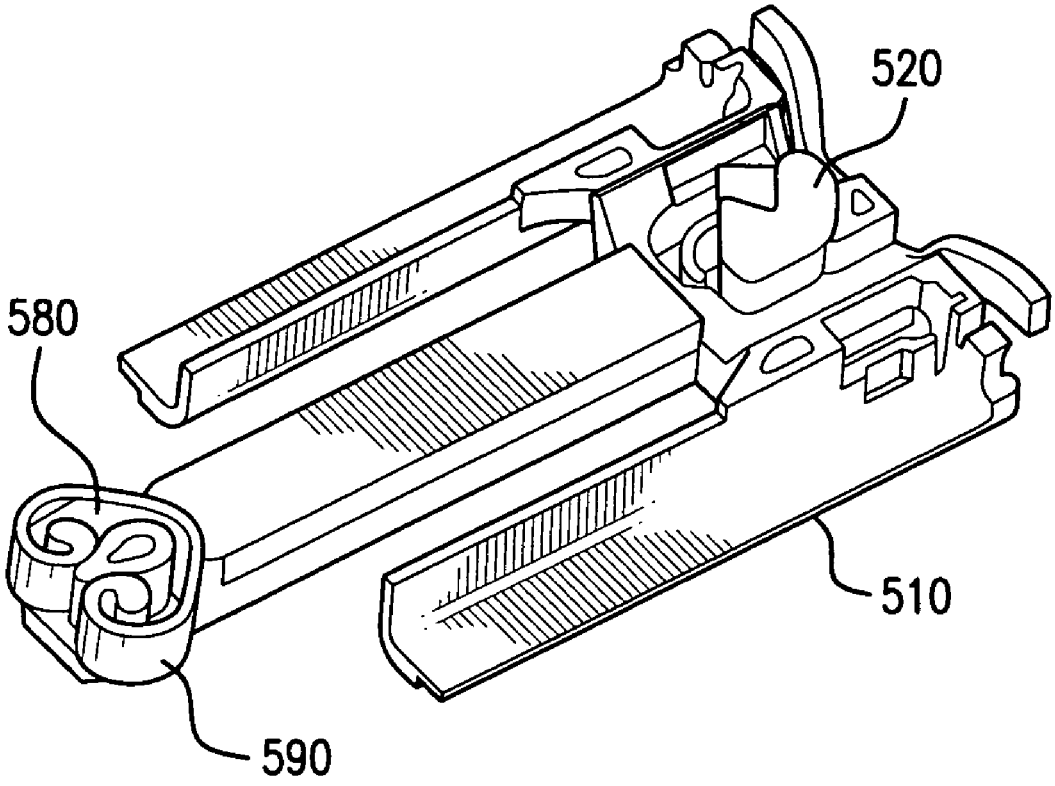
FIG. 42 is an enlarged view of the self-closing mechanism of FIG. 41.
Figure 43A:
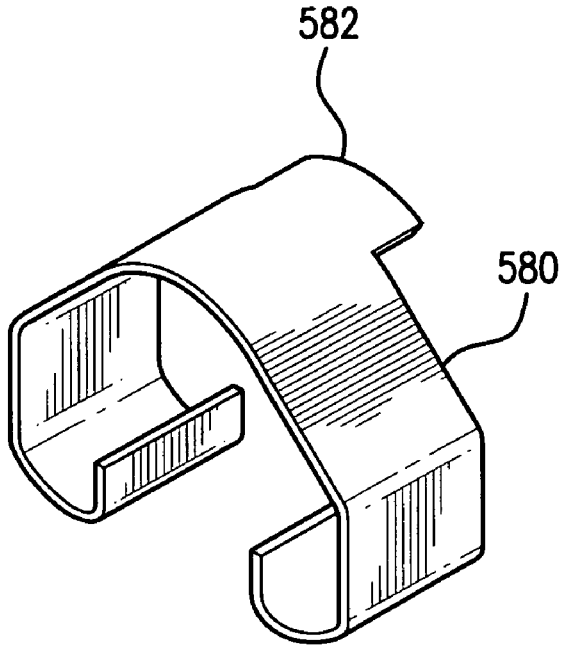
FIG. 43A shows a leaf spring in accordance with an embodiment of the invention.
Figure 43B:
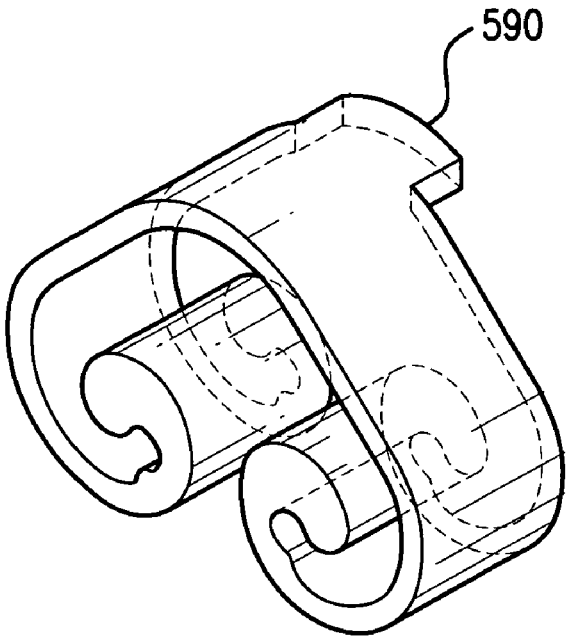
FIG. 43B shows a rubber liner in accordance with an embodiment of the invention.
Figure 44:
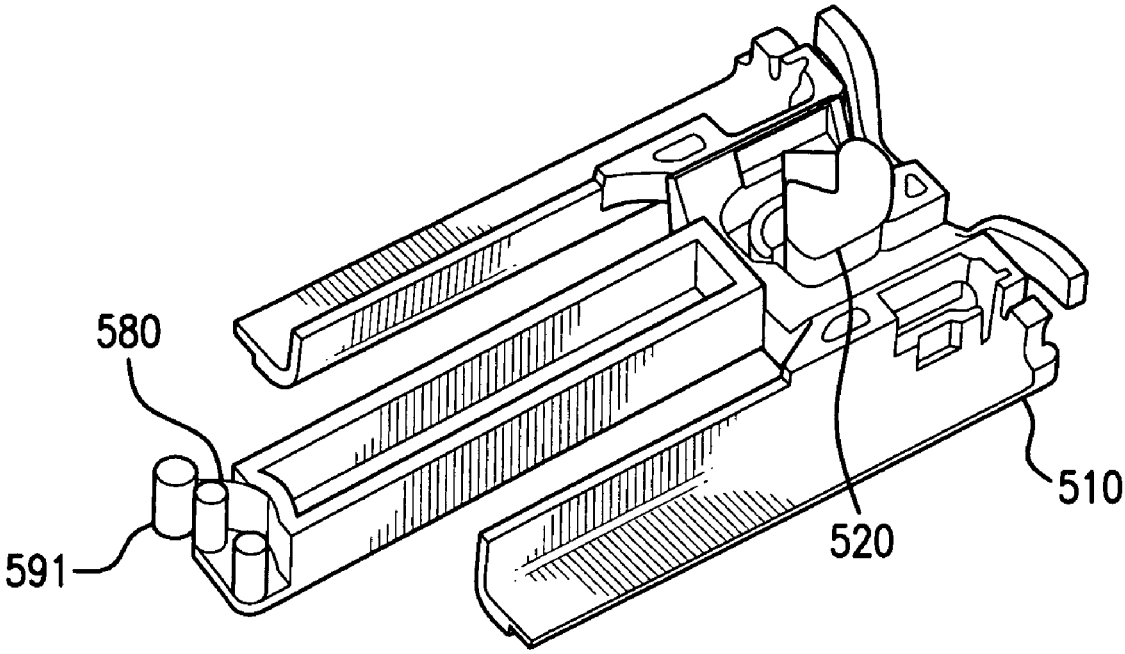
FIG. 44 shows a slider assembly in accordance with an alternative embodiment of the invention.

It is noted that, in the diagrams relating to the embodiments described thus far, the two parallel springs are hidden from view. More specifically, the springs are sandwiched between the spring shrouds 31, 331 and the cabinet member 110. Nevertheless, springs of the type shown, for example, in FIGS. 32 and 33 may be used in any of the embodiments of the invention. In addition, although in embodiments of the invention, the first and second springs are described as being parallel to one another, this is by way of illustration, and not limitation. Thus, in embodiments of the invention, the springs may be, e.g., angled in, or out, from the attachment points, as long as they are disposed symmetrically with respect to the centerline of the assembly.

Figure 23A:
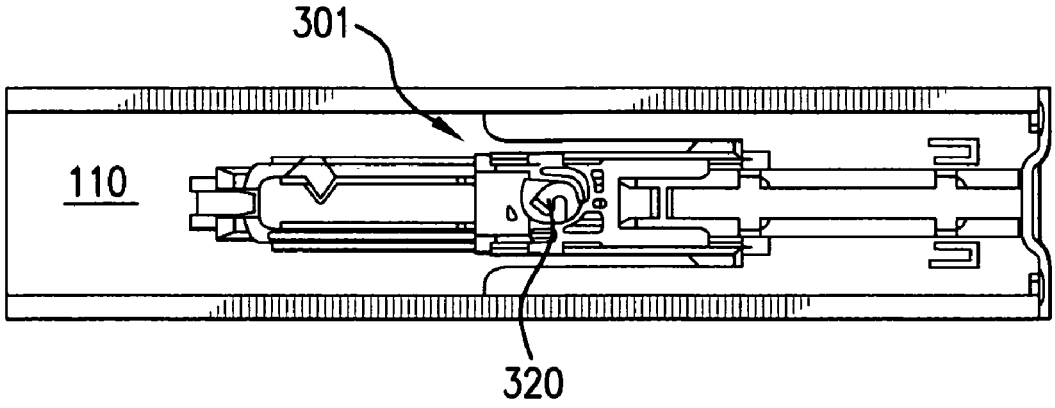
FIGS. 23A and 23B show, respectively, a top view and a bottom view of a cabinet member to which the self-closing mechanism shown in FIG. 22A is coupled.
Figure 23B:
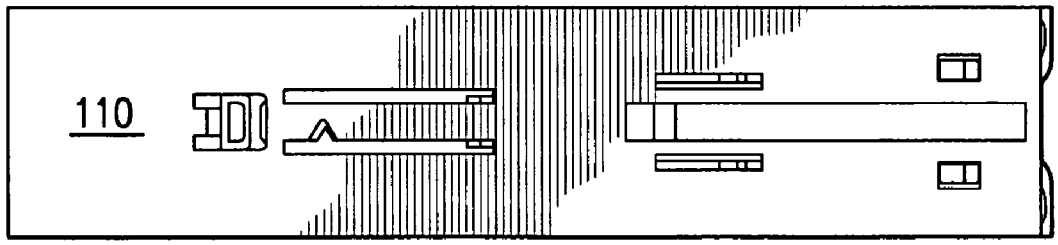
Figure 23C:
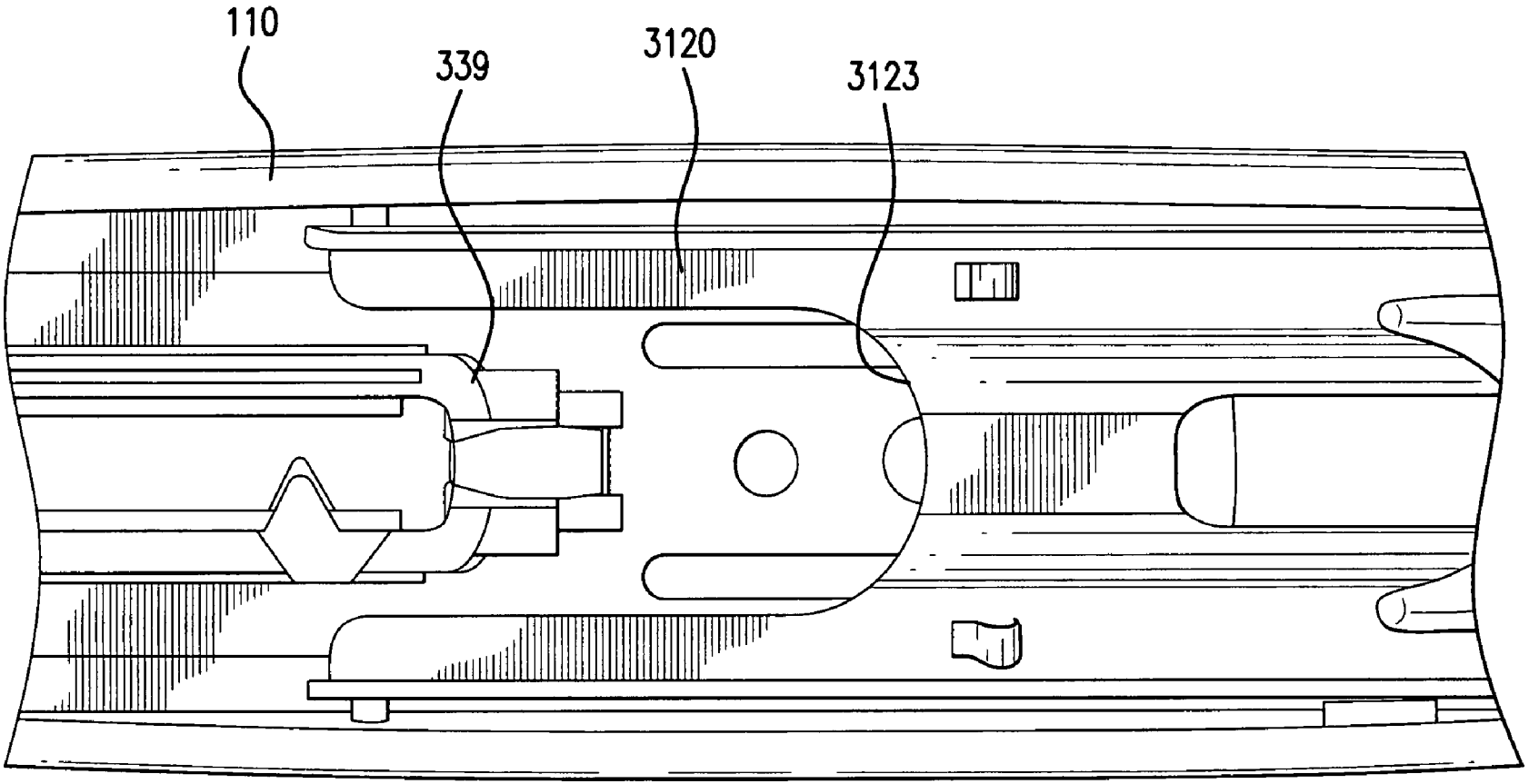
FIG. 23C shows a top view of an intermediate member as it is traveling towards a drawer-closed position.
Figure 23D:
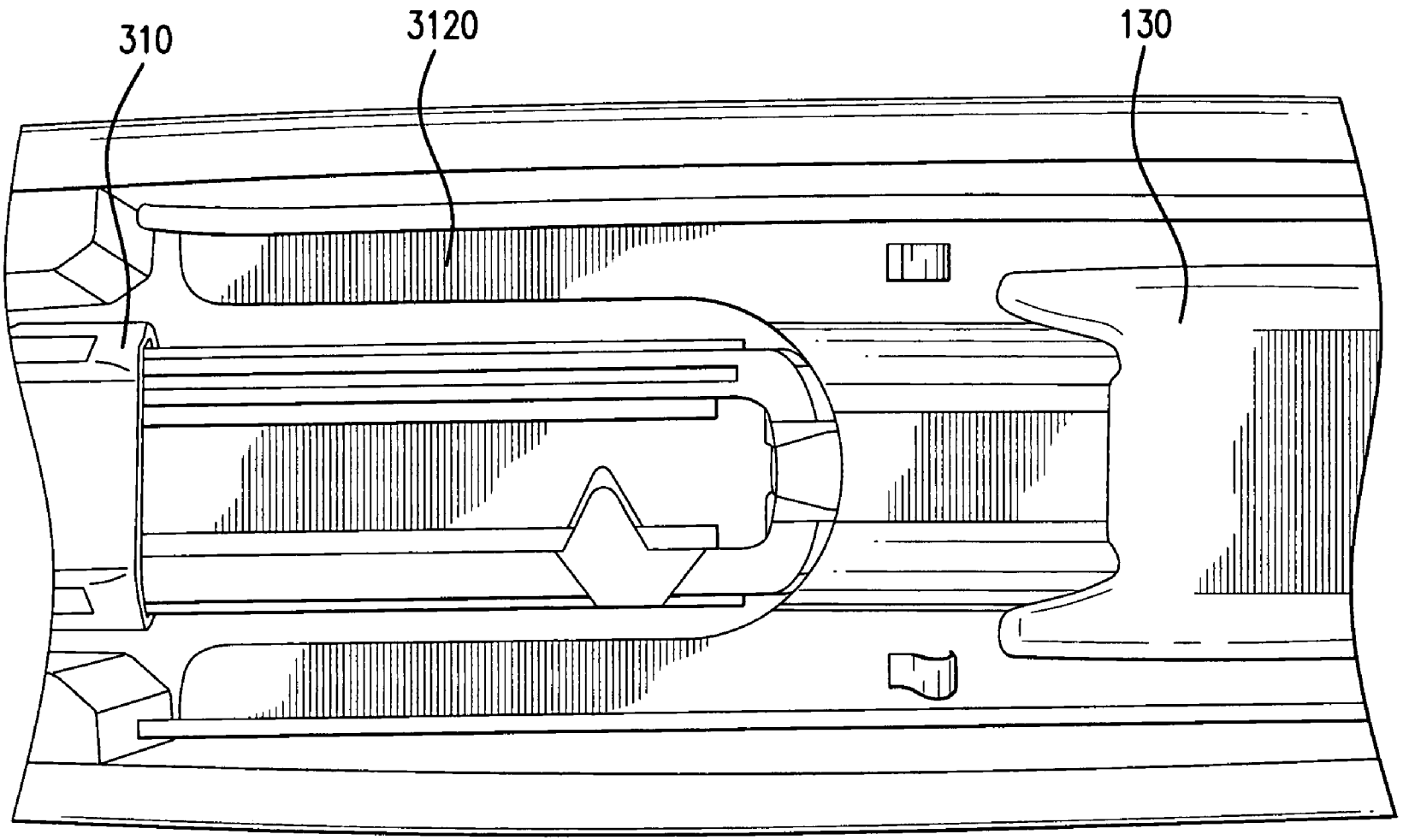
FIG. 23D shows the intermediate member of FIG. 23C in the closed position, and a drawer member as it is traveling towards the drawer-closed position.
Figure 24A:
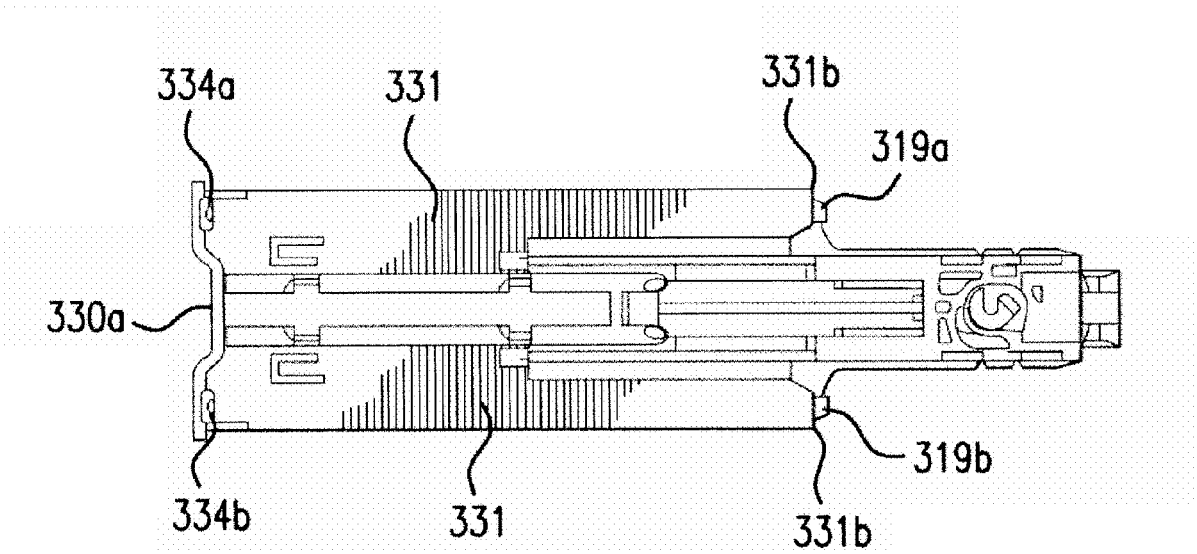
FIGS. 24A and 24B show, respectively, a top view and a bottom view of the self-closing mechanism shown in FIG. 22A in the open position.
Figure 24B:
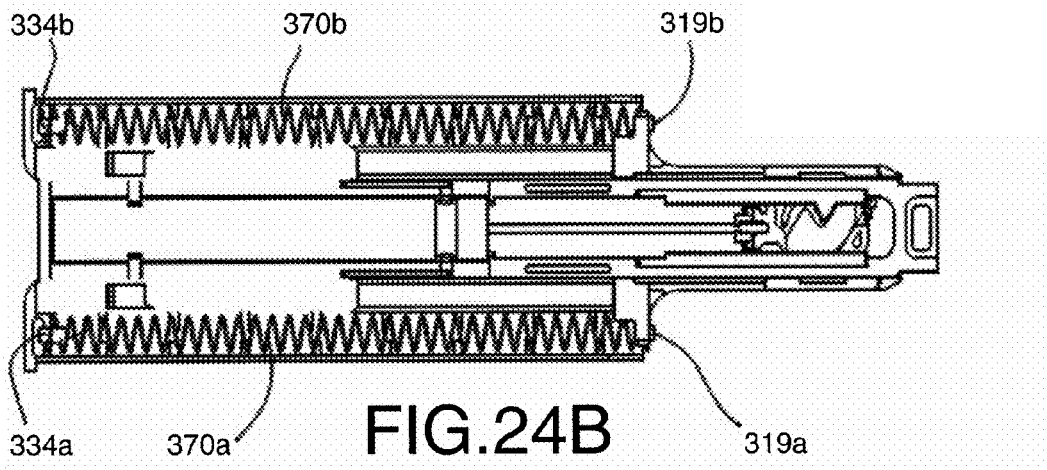

It is also noted that, rather than an aperture 14, the slider 310 includes an open front portion 314 to allow engagement and disengagement between the latch 320 and the pin 150. In addition, the slider 310 includes a substantially flat wall 318 to provide increased resistance to premature release, and to enhance the latch's ease of rotation when coming out of the locked position. Moreover, although it may, the slider 310 shown in FIGS. 31A-31D does not, include any impact fingers similar to the impact fingers 13 of slider 10. Rather, as shown in FIGS. 23C, 23D, and 29A, at its front end, the housing 330 includes arched flanges 339 that are configured to mate with an arcuate portion 3123 of the intermediate member 3120. With this configuration, as the intermediate member 3120 is traveling inwards (i.e., from right to left in FIGS. 23C and 23D), the arched flanges 339 not only restrict the inward travel of the intermediate member 3120, but also absorb its impact. As such, impact, whether from repeated normal closing, or from inadvertent closing with a hard impact, is absorbed by the housing 330, rather than the slider 310 and/or the latch 320.

As shown in FIGS. 31A-31E, the slider 310 also includes symmetrically-disposed fingers 312 on its undersurface. More specifically, in this embodiment, as the slider 310 translates along the rails 332, 333, it is guided by these rails, and retained in place as the fingers 312 wrap around the outer sides of the rails 332, 333. It is noted that, in the diagrams, two such retention fingers 312 are shown on each side of the slider 310. However, this is by way of example only, and embodiments of the invention may include one or more such fingers on each side of the slider.

The slider 310 also includes guide members 313*a*, 313*b* which are symmetrically disposed on opposite sides of the slider 310 (see FIGS. 31A-31E). As shown in these figures, the guide members 313*a*, 313*b* have outer edges that engage respective inner surfaces of the concave flanges 133, 135 of the drawer member 130. In operation, as the drawer member 130 travels towards the drawer-closed position, and just prior to engaging the latch 320 via the pin 150, guide member 313*a* mates with flange 133, and guide member 313*b* mates with flange 135. This allows the drawer member 130 to maintain its relationship with the slider 310 during the engagement and movement towards the closed position and helps prevent disengagement of the pin 150 from the latch.

As has been noted, in certain embodiments, the self-closing mechanisms described herein may not incorporate a damping mechanism. In this case, the closing movement of the slider 10, 310 is not dampened, and thus is allowed to close at full speed. This may reduce the overall size of the self-closing mechanism since the damper supports 35, 335 and a space for the damper within the stationary housing 30, 330 are no longer needed. The reduced size may strengthen the slide 100 as the intermediate member 120, 3120 can slide over a greater proportion of the self closing mechanism. While this non-dampened version of the present self closing mechanism would not prevent a drawer to which the slider is connected to slam against the associated cabinet, this non-dampened version may be appropriate for certain uses, i.e., when used with a drawer carrying light load or a drawer having a separate damping mechanism. On the other hand, non-dampened versions of the self-closing mechanisms described herein may include all of the components and associated structures as described herein, with the only difference being that the damping mechanism is removed from the overall self-closing mechanism.

In embodiments of the invention, the damper 40 may be a linear air damper to reduce the speed of closure and reduce slamming. The damper 40 may have internal mechanisms that allow it to provide damping in only the closing direction, thereby limiting any resistance in the opening direction. In yet other embodiments, the self-closing mechanism may include a fluid type damper.

As shown in FIGS. 32-35, in embodiments of the invention, the damping mechanism may be a rotary gear damper. Here, the self-closing mechanism would operate in a similar fashion to the embodiments described above. That is, a slider 410 may interface with a stationary housing 430 via a latch 420. As the self-closing mechanism is pulled to an open position (a pin 150 on a drawer member 130 pulls the latch in the opening, or drawer-open, direction), when the latch reaches a certain position, it locks into place until it is released (or triggered) by the pin during a closing stroke of the drawer slide. The slider houses a rotary gear damper 450 that mates with an idle gear 460. The idle gear is allowed to translate in a slot 419 so that, upon opening of the self-closing mechanism, the idle gear 460 disengages from the rotary damper. When the self-closing mechanism is being closed (i.e., as one or more springs 470 pull the slider 410 towards the drawer-closed position), the idle gear, which mates with a rack 439 on the stationary housing 430, moves to engage the rotary gear damper 450, thereby slowing the closing movement of the self-closing mechanism.

In certain embodiments which incorporate the rotary damper described above, the idle gear 460 may be a compound gear with the larger portion 462 mating with the rotary damper 450 and the smaller portion 464 mating with the rack 439. This configuration allows for more rotation in the rotary damper with the same length of stroke; the increase in rotation is proportional to the ratio between the larger portion and the smaller portion of the compound gear.

In yet other embodiments of the invention, the self-closing mechanism may be a friction type damper. For example, a friction type damper may comprise a sheet metal leaf spring and a rubber liner. When a force is applied to the sub-assembly, the sub-assembly will expand, and will create a friction force between the rubber liner and the stationary housing As shown in FIGS. 36-44, when the latch 520 is pulled up from preload position, both sides of the rubber liner 590 are in contact with the parallel rails 532, 533 of the housing 530. In embodiments of the invention, the parallel rails may be made of plastic. There is an air pocket between the rubber liner 590 and a leaf spring 580. Therefore, the magnitude of the pull up friction is small because the air pocket can be squeezed.

When the latch 520 is released from the locked position, the sub-assembly (i.e., the leaf spring 580 and the rubber liner 590) is stretched under maximum spring load. At this point, a slight amount of friction exists between the rubber liner 590 and the rails 532, 533, such that the rubber liner/leaf spring sub-assembly will not move immediately once the latch 520 is released. As a result, the latch 520 will move first, thereby exerting load on the sub-assembly. Under this load, the sub-assembly will extend horizontally in x direction, and create more interference between the rubber liner 590 and the rails 532, 533. This additional interference, in turn, generates more friction (i.e., dampening).

When the latch 520 is being pulled up, as it is released, the slider 510 will put a load on the sub-assembly, which results in a momentary friction (dampening) effect. The higher the position of the release point, the higher the friction force will be.

When there is an impact (or slam) at the locked position, the higher force will push down the sub-assembly more, and create more friction (or dampening) force. There is a limit stop in the slider 510 to prevent the sub-assembly from over-stretching and causing the sub-assembly to become stuck. It is noted that, at any time, the sub-assembly will be self-aligned along the center line of the slider by a tab 582 on leaf spring 580 and an alignment pocket 512 on the slider 510. This alignment feature will keep the sub-assembly always aligned along the center line of the main assembly.

In manufacturing, the housing 530, the slider 510, the latch 520, the rubber liner 590, and the leaf spring 580 form a sub-assembly which may be assembled first and then pushed (or assembled) into the cabinet member 110 of the slide sub-assembly. The slide subassembly, in turn, comprises the drawer member 130, the intermediate member 120, the cabinet member 110, as well as additional components.

In an alternative embodiment, a rubber pad may be applied along both (inner) sides of the housing's first and second rails, and the leaf spring may be rigid, i.e., without a rubber liner. In addition, the leaf spring may include a rounded contact end to ensure a smooth contact between the leaf spring and the rubber pad.

While the description above refers to particular embodiments of the present invention, it will be understood that many modifications may be made without departing from the spirit thereof. For example, rather than a pin-and-slot arrangement, the intermediate member and the latch may engage one another by means of other mating configurations, such as, e.g., a lanced tab on the intermediate member and a mating slot (or other receptacle) on the latch. Similarly, although, in embodiments of the invention, the damper 40 has been described as abutting the back end of the housing, in alternative embodiments, the housing may be open at its back end, with the damper 40 (or other damping mechanism) being secured to the housing via the damper supports and/or other means. The accompanying claims are therefore intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A drawer slide comprising:

a first slide member;

a second slide member, said second slide member being slidable with respect to the first slide member; and a self-closing mechanism comprising:

a stationary housing coupled to the first slide member, said housing having a back end, a front end, and a pair of parallel rails extending from the housing's front end toward the back end thereof;

a slider having a back end and a front end, said slider being configured to slide along said parallel rails and relative to the first slide member;

a first spring having a back end coupled to said back end of the housing, and a front end coupled to the slider; and a latch rotatably disposed within, and extending transversely through, said slider, wherein the latch is engageable with the second slide member and is configured to slide between said parallel rails, wherein the latch and slider move linearly between a first, drawer-closed position in which the latch and slider are disposed towards the back end of the housing and a second position in which the latch and slider are disposed proximate the front end of the housing, and wherein the latch's axis of rotation is perpendicular to the plane of the first slide member.

2. The drawer slide of claim 1, wherein the first slide member is a cabinet member.

3. The drawer slide of claim 1, further including a third slide member, wherein the third slide member is an intermediate member that is disposed between and slidably coupled to said first and second slide members.

4. The drawer slide of claim 1, wherein the second slide member includes an actuating member that engages the latch.

5. The drawer slide of claim 4, wherein the actuating member is a transverse pin, and the latch defines a slot in an upper portion thereof for receiving said pin.

6. The drawer slide of claim 1, further including a damping mechanism configured to dampen the motion of the slider.

7. The drawer slide of claim 6, wherein the damping mechanism dampens the motion of the slider as the slider moves from the second position towards the first, drawer-closed position.

8. The drawer slide of claim 6, wherein the damping mechanism is a cylindrical damper.

9. The drawer slide of claim 8, wherein the cylindrical damper has a front end, a back end that abuts an inner side of the housing's back end, and a piston rod that retractably protrudes from the damper's front end and is coupled to the slider.

10. The drawer slide of claim 1, wherein the latch includes an upper portion that protrudes transversely through, and is rotatable relative to, the slider, and a lower portion that translates between, and is rotatable relative to, said parallel rails.

11. The drawer slide of claim 10, wherein the housing further includes a male component disposed in a plane that is parallel to the plane of the first slide member, and the lower portion of the latch includes a triangular indent in an undersurface thereof for engaging with said male component.

12. The drawer slide of claim 11, wherein said first rail defines a vertical recess proximate a front end thereof, and the male component is disposed below said recess and extends laterally from the first rail towards said second rail.

13. The drawer slide of claim 12, wherein the lower portion of the latch includes a corner portion that is disposed above said triangular indent, and wherein, when the triangular indent engages the male component, the latch rotates to position the corner portion within said recess.

14. The drawer slide of claim 1, wherein:

the self-closing mechanism further includes a second spring having a front end and a back end;

the slider includes first and second spring posts;

the stationary housing includes third and fourth spring posts; and the front end of the first spring is coupled to the first spring post, the back end of the first spring is coupled to the third spring post, the front end of the second spring is coupled to the second spring post, and the back end of the second spring is coupled to the fourth spring post, such that the first and second springs are disposed symmetrically about a longitudinal centerline of the stationary housing.

15. The drawer slide of claim 14, wherein:

the third and fourth spring posts are disposed, respectively, proximate laterally opposite sides of the back end of the stationary housing; and the first and second springs are disposed in parallel and laterally spaced-apart relationship with respect to one another.

16. The drawer slide of claim 14, wherein said first and second spring posts are disposed proximate laterally-opposite sides of the slider's front end, and the slider further includes a pair of elongated, laterally-opposing spring shrouds.

17. The drawer slide of claim 14, wherein the slider further includes impact fingers at the front end thereof.

18. The drawer slide of claim 14, wherein said first and second spring posts are disposed proximate laterally-opposite sides of the slider's back end.

19. The drawer slide of claim 14, wherein the housing further includes elongated, laterally-opposing first and second spring shrouds that respectively cover the first and second springs.

20. The drawer slide of claim 19, wherein each of said first and second spring shrouds has a substantially inverted-U-shaped cross-section, such that the first spring is sandwiched between the first shroud and the first slide member, and the second spring is sandwiched between the second shroud and the first slide member.

21. The drawer slide of claim 19, wherein the first and second springs extend as the slider moves away from the drawer-closed position.

22. The drawer slide of claim 21, wherein, at the slider's most-forward position, the latch is locked in place, the first spring shroud covers substantially the entire extended length of the first spring and the second spring shroud covers substantially the entire extended length of the second spring.

23. A drawer slide comprising:

a first slide member;

a second slide member, said second slide member including a transverse pin and being slidable with respect to the first slide member; and a self-closing mechanism comprising:

a slider having a back end, a front end, and first and second spring posts disposed proximate laterally-opposite sides of the slider's back end;

a stationary housing coupled to the first slide member, said housing having a back end, a front end, a pair of parallel rails extending from the housing's front end toward the back end thereof, and third and fourth spring posts disposed, respectively, proximate laterally opposite sides of the back end thereof, wherein the slider is configured to slide along said parallel rails and relative to the first slide member;

first and second springs, each spring having a back end and a front end, wherein the front end of the first spring is coupled to the first spring post, the back end of the first spring is coupled to the third spring post, the front end of the second spring is coupled to the second spring post, and the back end of the second spring is coupled to the fourth spring post, such that the first and second springs are disposed in parallel and laterally spaced-apart relationship with respect to one another;

a latch rotatably disposed within, and extending transversely through, said slider, wherein the latch is configured to receive said pin so as to engage with the second slide member, and wherein the latch's axis of rotation is perpendicular to the plane of the first slide member; and a damping mechanism configured to dampen the motion of the slider.

24. The drawer slide of claim 23, wherein the latch is configured to slide between said parallel rails, and wherein the latch and slider move linearly between a first, drawer-closed position in which the latch and slider are disposed towards the back end of the housing and a second position in which the latch and slider are disposed proximate the front end of the housing.

25. The drawer slide of claim 24, wherein, in the second position, the latch is locked in place.

26. The drawer slide of claim 23, wherein the first slide member is a cabinet member, and the second slide member is a drawer member.

27. A drawer slide comprising:

a first slide member;

a second slide member, said second slide member being slidable with respect to the first slide member; and a self-closing mechanism comprising:

a stationary housing coupled to the first slide member, said housing having a back end, a front end, and a pair of parallel rails extending from the housing's front end toward the back end thereof;

a slider having a back end and a front end, said slider being configured to slide along said parallel rails and relative to the first slide member;

a first spring having a back end coupled to said back end of the housing, and a front end coupled to the slider; and a latch rotatably disposed within, and extending transversely through, said slider, wherein the latch is engageable with the second slide member and is configured to slide between said parallel rails, wherein the latch and slider move linearly between a first, drawer-closed position in which the latch and slider are disposed towards the back end of the housing and a second position in which the latch and slider are disposed proximate the front end of the housing, wherein the latch includes an upper portion that protrudes transversely through, and is rotatable relative to, the slider, and a lower portion that translates between, and is rotatable relative to, said parallel rails, wherein the housing further includes a male component, and the lower portion of the latch includes a triangular indent in an undersurface thereof for engaging with said male component, and wherein said first rail defines a vertical recess proximate a front end thereof, and the male component is disposed below said recess and extends laterally from the first rail towards said second rail.

28. The drawer slide of claim 27, wherein the lower portion of the latch includes a corner portion that is disposed above said triangular indent, and wherein, when the triangular indent engages the male component, the latch rotates to position the corner portion within said recess.

29. The drawer slide of claim 27, wherein the first slide member is a cabinet member.

30. The drawer slide of claim 27, further including a third slide member, wherein the third slide member is an intermediate member that is disposed between and slidably coupled to said first and second slide members.

31. The drawer slide of claim 27, wherein the second slide member includes an actuating member that engages the latch.

32. The drawer slide of claim 31, wherein the actuating member is a transverse pin, and the latch defines a slot in an upper portion thereof for receiving said pin.

33. The drawer slide of claim 27, further including a damping mechanism configured to dampen the motion of the slider.

34. The drawer slide of claim 33, wherein the damping mechanism dampens the motion of the slider as the slider moves from the second position towards the first, drawer-closed position.

35. The drawer slide of claim 33, wherein the damping mechanism is a cylindrical damper.

36. The drawer slide of claim 35, wherein the cylindrical damper has a front end, a back end that abuts an inner side of the housing's back end, and a piston rod that retractably protrudes from the damper's front end and is coupled to the slider.

37. The drawer slide of claim 27, wherein:

the self-closing mechanism further includes a second spring having a front end and a back end;

the slider includes first and second spring posts;

the stationary housing includes third and fourth spring posts; and the front end of the first spring is coupled to the first spring post, the back end of the first spring is coupled to the third spring post, the front end of the second spring is coupled to the second spring post, and the back end of the second spring is coupled to the fourth spring post, such that the first and second springs are disposed symmetrically about a longitudinal centerline of the stationary housing.

38. The drawer slide of claim 37, wherein:

the third and fourth spring posts are disposed, respectively, proximate laterally opposite sides of the back end of the stationary housing; and the first and second springs are disposed in parallel and laterally spaced-apart relationship with respect to one another.

39. The drawer slide of claim 37, wherein said first and second spring posts are disposed proximate laterally-opposite sides of the slider's front end, and the slider further includes a pair of elongated, laterally-opposing spring shrouds.

40. The drawer slide of claim 37, wherein the slider further includes impact fingers at the front end thereof.

41. The drawer slide of claim 37, wherein said first and second spring posts are disposed proximate laterally-opposite sides of the slider's back end.

42. The drawer slide of claim 37, wherein the housing further includes elongated, laterally-opposing first and second spring shrouds that respectively cover the first and second springs.

43. The drawer slide of claim 42, wherein each of said first and second spring shrouds has a substantially inverted-U-shaped cross-section, such that the first spring is sandwiched between the first shroud and the first slide member, and the second spring is sandwiched between the second shroud and the first slide member.

44. The drawer slide of claim 42, wherein the first and second springs extend as the slider moves away from the drawer-closed position.

45. The drawer slide of claim 44, wherein, at the slider's most-forward position, the latch is locked in place, the first spring shroud covers substantially the entire extended length of the first spring and the second spring shroud covers substantially the entire extended length of the second spring.

* * * * *